US008733877B2

(12) United States Patent
Inoue

(10) Patent No.: US 8,733,877 B2
(45) Date of Patent: May 27, 2014

(54) METHOD AND APPARATUS FOR DETECTING DISCHARGE DEFECT, IMAGE PROCESSING APPARATUS, COMPUTER-READABLE RECORDING MEDIUM, AND PRINTING SYSTEM

(71) Applicant: FUJIFILM Corporation, Tokyo (JP)

(72) Inventor: Yoshiaki Inoue, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/732,983

(22) Filed: Jan. 2, 2013

(65) Prior Publication Data

US 2013/0187970 A1 Jul. 25, 2013

(30) Foreign Application Priority Data

Jan. 23, 2012 (JP) ..... 2012-011328

(51) Int. Cl.
*B41J 2/12* (2006.01)

(52) U.S. Cl.
USPC ..... 347/14; 347/78; 347/81

(58) Field of Classification Search
USPC ..... 347/14, 15, 19, 41, 78–81
See application file for complete search history.

(56) References Cited

U.S. PATENT DOCUMENTS

| | | | | |
|---|---|---|---|---|
| 6,488,353 | B1 | 12/2002 | Itoyama et al. | |
| 8,322,813 | B2 | 12/2012 | Kasai et al. | |
| 2010/0253982 | A1 | 10/2010 | Kasai et al. | |
| 2013/0141484 | A1* | 6/2013 | Kasai et al. | 347/14 |

FOREIGN PATENT DOCUMENTS

| | | | |
|---|---|---|---|
| JP | H10-000764 | A | 1/1998 |
| JP | 2001-007969 | A | 1/2001 |
| JP | 2004-009474 | A | 1/2004 |
| JP | 2009-239530 | A | 10/2009 |
| JP | 2010-240885 | A | 10/2010 |
| JP | 2011-201216 | A | 10/2011 |
| JP | 2011-209105 | A | 10/2011 |

OTHER PUBLICATIONS

An Office Action; "Notice of Reasons for Rejection," issued by the Japanese Patent Office on Nov. 29, 2013, which corresponds to Japanese Patent Application No. 2012-011328 and is related to U.S. Appl. No. 13/732,983; with English language translation.

* cited by examiner

*Primary Examiner* — Thinh Nguyen
(74) *Attorney, Agent, or Firm* — Studebaker & Brackett PC

(57) ABSTRACT

A discharge defect of a nozzle in an apparatus that forms an image on a medium by discharging liquid from a liquid discharge head based on image data is accurately detected. A discharge defect of a nozzle is detected by comparing data (reference data) of a reference image with read data obtained by reading an output image. In this case, a mark for matching the read pixel and the nozzle position with each other is recorded on the medium, and the correspondence relationship is specified by reading the mark. In addition, data items that are converted to have the nozzle resolution by performing a filtering process corresponding to the human visual characteristics for both the data of the reference image and the data of the read image are compared with each other, thereby detecting a discharge defect of a nozzle.

20 Claims, 22 Drawing Sheets

(FIG. 13 Continued)
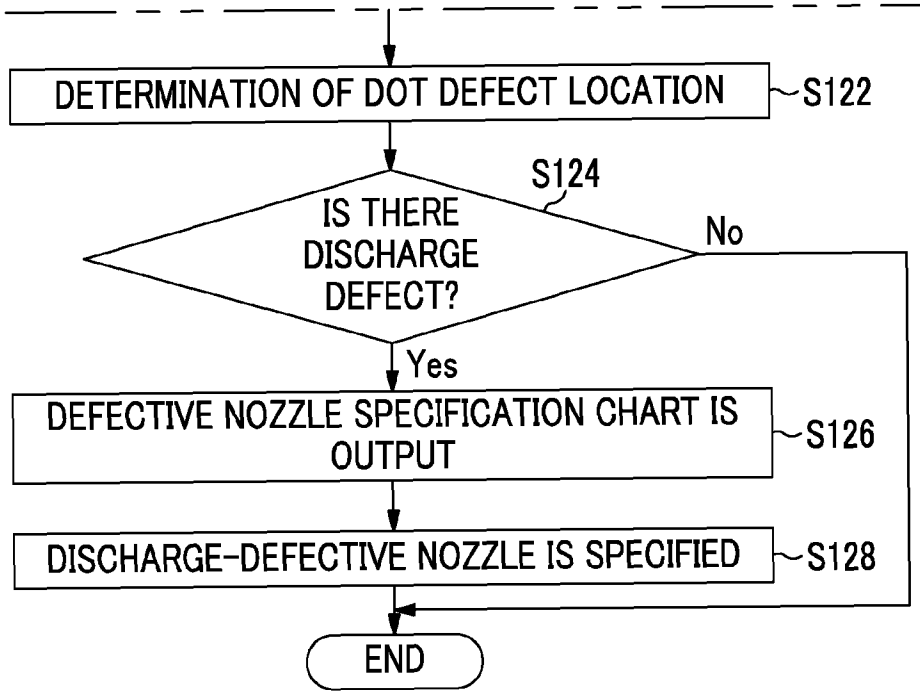

(FIG. 18 Continued)
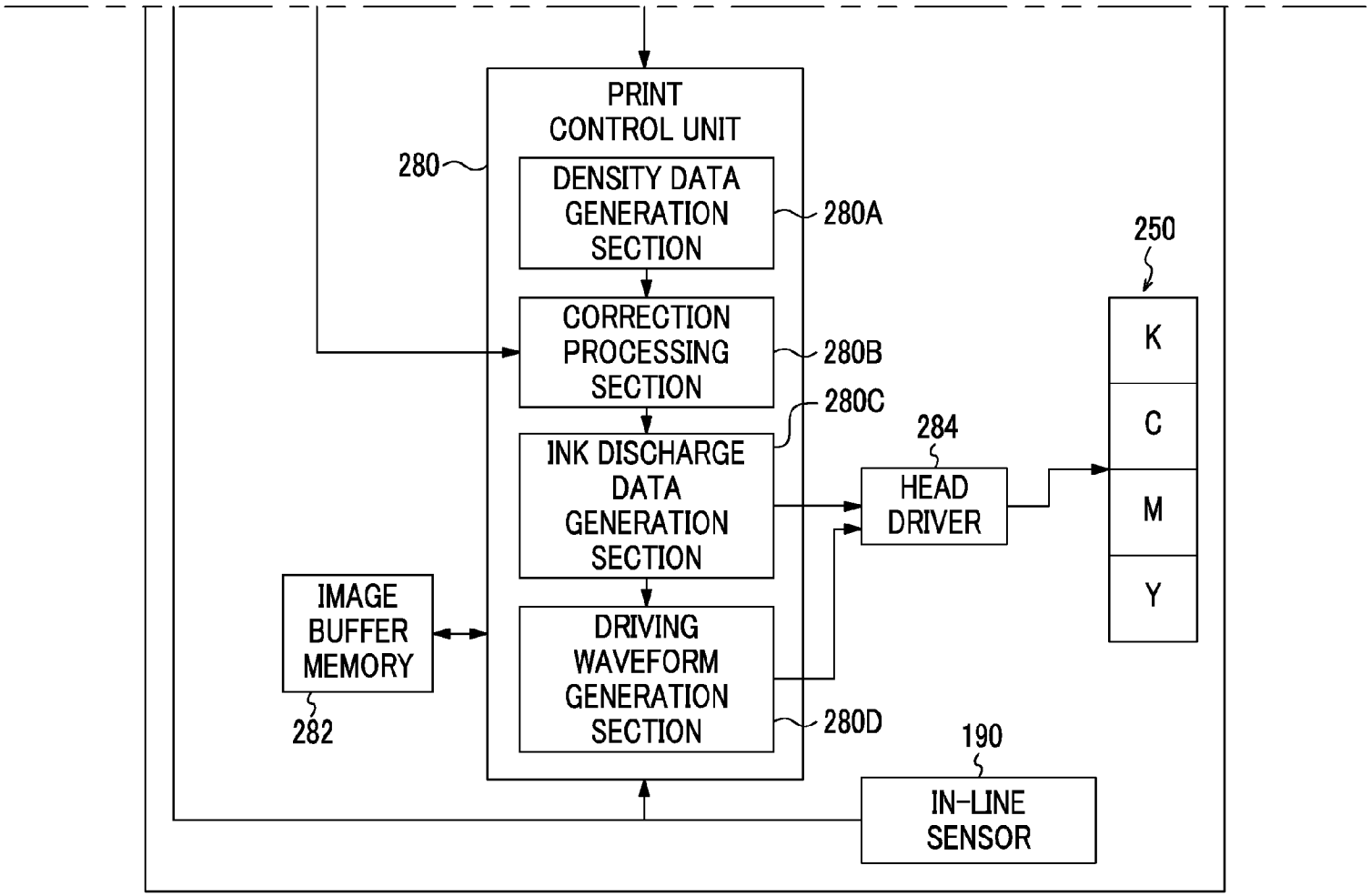

METHOD AND APPARATUS FOR DETECTING DISCHARGE DEFECT, IMAGE PROCESSING APPARATUS, COMPUTER-READABLE RECORDING MEDIUM, AND PRINTING SYSTEM

BACKGROUND OF THE INVENTION

1. Field of the Invention

The present invention relates to a method and apparatus for detecting discharge defects in a liquid discharge head used in an ink jet printer or the like, a computer-readable recording medium, and a printing system using the detection technique.

2. Description of the Related Art

Regarding a technique of detecting a discharge defect in an ink jet head having a plurality of liquid discharge ports (nozzles), JP2010-240885A discloses a method of comparing image data (reference data) as a comparison reference for quality determination with read data, which is obtained by reading a printed image with a scanner, and detecting a discharge defect of a nozzle from the difference between the pixel values of both the data items. JP2010-240885A discloses: causing a scanner to read an image, which is drawn on paper by discharging ink from a nozzle while moving a head unit and the paper relative to each other based on image data for printing, in a resolution that is lower than the resolution of the image data in the relative movement direction of the head unit and the paper; generating reference data having the same resolution as the resolution in the relative movement direction in the read data, based on the image data; and detecting a nozzle defect by comparing a plurality of read data pixels in the same pixel row in the relative movement direction on the read data with a plurality of reference data pixels, each corresponding to the plurality of the read data pixels.

SUMMARY OF THE INVENTION

However, the technique disclosed in JP2010-240885A has the following problems.

(1) Regarding the Method of Comparison with the Reference Data

In the technique disclosed in JP2010-240885A, when comparing the read data with the reference data for determination of a discharge-defective nozzle, a difference value between the read data pixel and the reference data pixel corresponding to the read data pixel is simply compared with a threshold value to determine a difference between the both pixels. However, in fact, a defect in the print image is determined by observing the print visually. Therefore, in order to determine discharge defects automatically and more accurately at a level consistent with human visual determination, image structure processing needs to be performed in consideration of human visual characteristics. In this respect, there is room for improvement in the technique disclosed in JP2010-240885A.

(2) Regarding the Matching Between a Pixel of Reference Data or Read Image Data and the Nozzle Position When trying to produce a large number of prints in a single-pass type ink jet printing apparatus, the accuracy of the relative movement of paper, i.e., the positional accuracy in a paper width direction, is not very high. For this reason, alignment processing for matching the pixel position of a captured image obtained by imaging the print with the position of a nozzle of an ink jet head (line head), which has been used to draw the image, is necessary. In particular, when generating a reference image from the image data for printing as in JP2010-240885A, the processing for matching the pixel position of a captured image with the position of a nozzle is important. However, this point is not mentioned in JP2010-240885A.

(3) Regarding the Reading Resolution in a Nozzle Width Direction

JP2010-240885A discloses that the reading resolution of a scanner in the paper width direction is preferably set to a higher resolution than the printed image (for example, in the case of an image printed at 720 dpi, a resolution equal to or higher than 1440 dpi that is twice the resolution of 720 dpi) (paragraph [0012] in JP2010-240885A). However, for example, a line head including a nozzle row in which nozzles are aligned in a paper width direction perpendicular to the paper transport direction is adopted in the single-pass type printing apparatus in order to have a high productivity. Accordingly, an image to be drawn also becomes quite wide. Reading the entire image region with a high-resolution scanner is possible by providing a plurality of cameras (or imaging devices) side by side. In this case, however, the number of data items is increased, and it takes additional time to process the data. In addition, in order to execute high-speed processing corresponding to the printing speed, the cost is increased, and this is not realistic.

In view of such a situation, it is an object of the present invention to solve the above-described problems and provide a method and apparatus capable of accurately detecting a discharge defect, an image processing apparatus, a computer-readable recording medium, and a printing system.

In order to achieve the above-described object, according to an aspect of the present invention, there is provided a discharge defect detection method including: an image reading step of reading an image recorded on a medium to acquire read data of the image, the image being recorded on the medium by discharging liquid from a plurality of nozzles based on image data while moving a liquid discharge head having a nozzle row, in which the plurality of nozzles is aligned, and the medium relative to each other; a visual characteristic correction step of performing a filtering process corresponding to human visual characteristics for the read data acquired in the image reading step; a nozzle position matching step of specifying a correspondence relationship between a pixel position of the read data and a nozzle position in the liquid discharge head from a mark that is recorded in a margin outside an image region on the medium by a nozzle set in advance; a resolution conversion step of converting data, for which the filtering process has been performed in the visual characteristic correction step, into data having a nozzle resolution of the liquid discharge head using the correspondence relationship specified in the nozzle position matching step; a reference data generation step of generating reference data, which indicates a reference image, from the image data or the read data acquired in the image reading step; a reference data storage step of storing the reference data generated in the reference data generation step; and a defect detection step of detecting a discharge defect of a nozzle in the nozzle row by comparing the read data for which nozzle resolution conversion has been performed, which is generated by performing the filtering process in the visual characteristic correction step and a process for conversion into the nozzle resolution in the resolution conversion step for the read data generated from the image read in the image reading step, with the reference data for which nozzle resolution conversion has been performed, which is generated through the filtering process corresponding to the visual characteristics and the process for conversion into the nozzle resolution of the liquid discharge head.

Other aspects of the present invention will become apparent from the explanation of the present specification and the accompanying drawings.

According to the aspect of the present invention, a defective nozzle can be appropriately detected by taking the human visual characteristics into consideration. In addition, since the alignment of the nozzle position and the pixel position is performed by recording a mark on a medium using a specific nozzle, the position of a defective nozzle can be specified with high accuracy. In addition, according to the aspect of the present invention, a high-resolution image reading unit (scanner) does not necessarily be used. Therefore, high-precision defective nozzle detection can be realized at high speed and low cost.

DESCRIPTION OF THE PREFERRED EMBODIMENTS

Hereinafter, embodiments of the present invention will be described in detail with reference to the accompanying drawings.

First Embodiment

<Overall Configuration of a Printing System>

Figure 1:
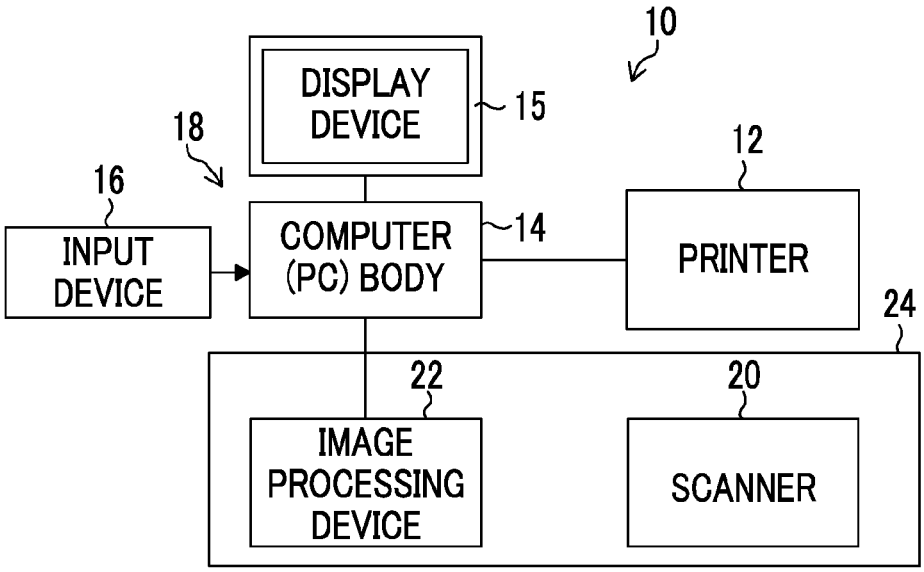
FIG. 1 is a block diagram showing the configuration of a printing system according to an embodiment of the present invention.

FIG. 1 is a block diagram showing the configuration of a printing according to an embodiment of the present invention.

A printing system 10 includes a printer 12, a computer (PC) body 14, a display device 15, an input device 16, a scanner 20 serving as an image reading unit that reads an output image, and an image processing device 22 that analyzes data of the read image acquired from the scanner 20.

The printer 12 is a single-pass type printing apparatus. That is, the printer 12 includes an ink jet head having a row of nozzles with which an entire drawing region in a paper width direction (second direction), which is perpendicular to a paper transport direction (first direction), can be drawn at once (by a single paper feed) in a predetermined recording resolution.

The computer body 14 is communicably connected to the printer 12 through a wired or wireless communication interface. A printer driver for controlling the printer 12 is installed in the computer body 14. Accordingly, the computer body 14 functions as a control device of the printer 12. In addition, the computer body 14 supplies image data, which is required to make the printer 12 print an image, to the printer 12.

The display device 15 and the input device 16 are connected to the computer body 14. The display device 15 and the input device 16 function as a user interface (UI). For example, a liquid crystal display or an organic EL display may be used as the display device 15. Various kinds of means, such as a keyboard, a mouse, a touch panel, and a track ball, can be used as the input device 16, and their appropriate combination is also possible. Since the operator (user) can input various kinds of information using the input device 16 while watching the content displayed on the screen of the display device 15, the operator can operate the printer 12, the image processing device 22, or the like. In addition, the state or the like of the system can be grasped (checked) through the display device 15. A computer set, which includes the computer body 14, the display device 15, and the input device 16, is collectively referred to as a computer 18.

The scanner 20 includes a linear sensor type imaging device, in which a plurality of photoelectric conversion elements (photosensitive pixel units) are arrayed in a linear shape. For example, an imaging device capable of performing color separation, such as a 3CCD color line sensor in which CCD line sensors of RGB colors are aligned, is used as the scanner 20 in the present embodiment. By using such a color imaging device, information of each color that can be printed by the printer 12 can be read.

In addition, in the case of the single-pass type printer 12, a configuration is preferable in which the scanner 20 serving as an image reading unit that reads a printed image is placed on the paper transport path. Such a configuration is advantageous in that, when printing a large number of sheets of paper, each printed image is checked during paper transport.

The scanner 20 in the present embodiment has a photoelectric conversion element row (read pixel row) capable of reading an image of the paper width on the paper at once (by a single paper feed) in the paper width direction perpendicular to the paper transport direction, and. The scanner 20 is placed on the paper transport path. The image on the paper is read and converted into an image signal by the scanner 20 while the paper printed by the printer 12 is being transported in one direction. In this manner, electronic image data (read data) of the read image that has been read by the scanner 20 is generated.

The reading resolution of the scanner 20 is preferably a high resolution in the paper width direction as much as possible. Ideally, the reading resolution of the scanner 20 is preferably equal to or higher than twice the recording resolution of the printer 12 in the paper width direction. For example, when the printer 12 has a resolution (recording resolution) of 600 dpi, the reading resolution of the scanner 20 in the paper width direction is preferably equal to or higher than 1200 dpi, which is twice the resolution of the printer 12. However, the implementation of the present invention does not necessarily require using such a high resolution scanner.

On the other hand, the reading resolution of the scanner 20 in the paper feed direction is set to the resolution with which the scanner 20 can perform data processing, and a lower resolution than the recording resolution of the printer 12 is preferably set. For example, the reading resolution of the scanner 20 in the paper feed direction may be set to a low resolution which is 1/10 or less of the reading resolution of the scanner 20 in the paper width direction. Specifically, in the case of the printer 12 having a resolution of 600 dpi, a scan speed, at which the reading resolution of the scanner 20 in the paper feed direction is 100 dpi, which is 1/12 of the reading resolution (for example, 1200 dpi) in the paper width direction, can be set.

Figure 2:
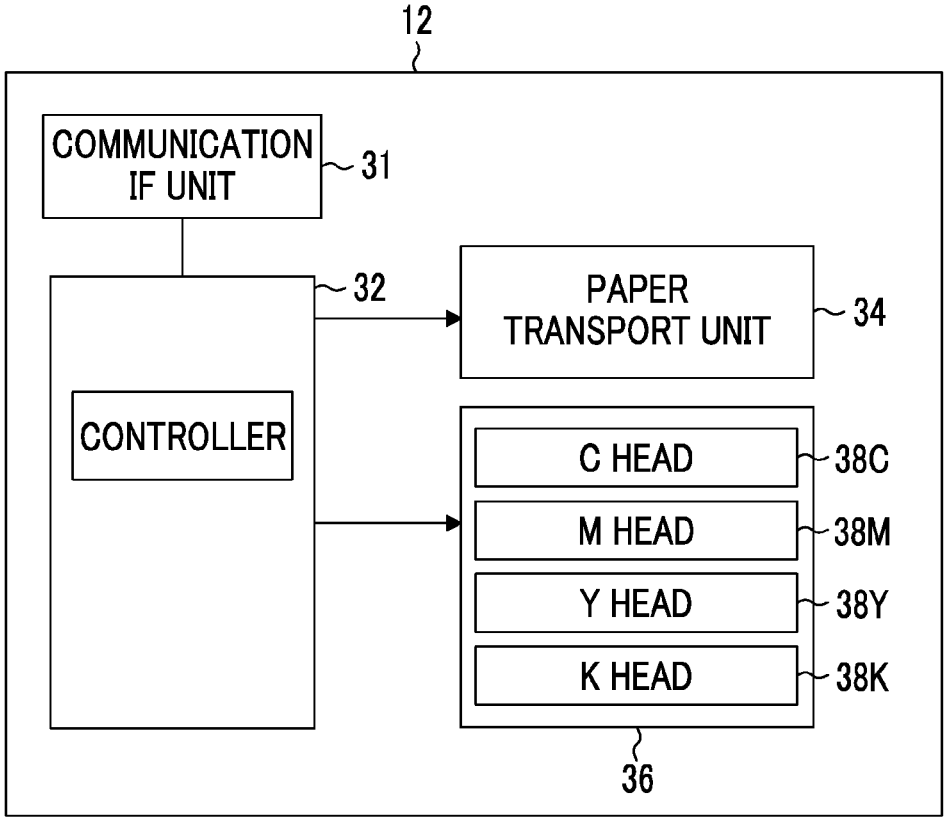
FIG. 2 is a block diagram showing the configuration of a printer.

FIG. 2 is a block diagram showing the configuration of the printer 12. The printer 12 includes a communication interface unit 31, a controller 32, a paper transport unit 34, and a head unit 36. The printer 12 is connected to the computer 18 (refer to FIG. 1) through the communication interface unit 31.

The head unit 36 is configured to include ink jet heads (hereinafter, referred to as heads) 38C, 38M, 38Y, and 38K as liquid discharge heads. In the present embodiment, a case will be described in which ink of four colors of cyan (C), magenta (M), yellow (Y), and black (K) is used and the heads 38C, 38M, 38Y, and 38K are provided for each color as means for discharging ink of each color. However, combinations of ink colors or the number of colors is not limited to the present embodiment. The number of heads is also not limited to the present embodiment. In addition, in the following explanation, the plurality of heads 38C, 38M, 38Y, and 38K in matters (matters common to each head), in which ink colors do not need to be specified, is referred to as a head 38 using reference numeral 38.

On an ink discharge surface (nozzle surface) of each head 38, a plurality of nozzles for ink discharge are arrayed over a length corresponding to the maximum width of an image forming region of the paper. As to a nozzle arrangement form, a one-dimensional nozzle arrangement, in which the nozzles are aligned on a straight line (in a row) at certain intervals may be used. Otherwise, a so-called zigzag arrangement, in which two nozzle rows are disposed so as to be shifted from each other in the nozzle row direction by the ½ pitch of the distance between nozzles (pitch between nozzles) in each nozzle row, may be used. In particular, in order to realize high recording resolution, a configuration in which a plurality of nozzles are arrayed on the ink discharge surface in a two-dimensional manner, such as a matrix array in which three or more nozzle rows are aligned, is preferable.

In the case of an ink jet head having a two-dimensional nozzle array, a projection nozzle array when nozzles in the two-dimensional nozzle array are projected (orthographically projected) so as to be aligned along a direction (equivalent to the paper width direction or the main scanning direction) perpendicular to the paper feed direction (equivalent to the medium transport direction or the sub-scanning direction) may be considered as an equivalent of one nozzle row in which nozzles are aligned at approximately equal distances in the main scanning direction (medium width direction) and in the nozzle density to achieve the recording resolution. The "equal distance" referred to herein means a substantially equal distance between droplet ejection points that can be recorded by the ink jet printing system. For example, in consideration of the movement of a droplet on the medium due to a manufacturing error or droplet landing interference, a case where some distances are slightly different from the others is also included in the concept of "equal distance". When a projection nozzle row (also referred to as a "substantial nozzle row") is taken into consideration, nozzle positions (nozzle numbers) can be matched in order of the projection nozzles aligned along the main scanning direction. In the following explanation, "nozzle position" refers to the position of a nozzle in this substantial nozzle row.

The controller 32 controls the paper transport unit 34 or the head unit 36 based on the image data, a control signal, or the like received from the computer 18, thereby performing control to print an image on the paper as a printing medium. The paper transport unit 34 is means for transporting a medium, such as printing paper. Although the detailed structure of the paper transport unit 34 is not shown in the drawings, the paper transport unit 34 includes a paper feed roller, a transport motor, a motor driving circuit, and the like. In the single-pass type printer 12, the paper transport unit 34 is equivalent to a "relative movement unit".

The controller 32 may function as image signal processing means for performing various kinds of processing, such as color conversion processing, density correction processing, non-discharge correction processing, and halftone processing, on image data acquired through the communication interface unit 31. The controller 32 generates a discharge control signal (print data) for controlling the driving of a discharge energy generating element (for example, a piezoelectric element), which corresponds to each nozzle of each head 38, in response to the image data, and supplies the discharge control signal to each head 38 and also controls the transport of paper. The controller 32 controls the discharge timing of each nozzle by detecting the position of paper with an encoder or the like while transporting the paper at the fixed speed. Discharge from the nozzle is performed according to the discharge control signal transmitted from the controller 32 to each head 38, thereby forming an image on the paper. The controller 32 is equivalent to a "printing control unit".

The image processing device 22 functions as a signal processing device that performs processing for detecting a discharge defect by analyzing the read image data acquired by the scanner 20. In the present embodiment, a discharge defect detecting apparatus 24 is formed by the combination of the scanner 20 serving as an image reading unit and the image processing device 22 that performs processing for analyzing the image acquired from the scanner 20. In addition, the signal processing function of the image processing device 22 can be realized by the hardware configuration of a computer and software (program). For example, a program that realizes a function of the image processing device 22 may be loaded onto the computer 18, and the computer 18 may be made to function as the image processing device 22.

<Process Flow>

Figure 3:
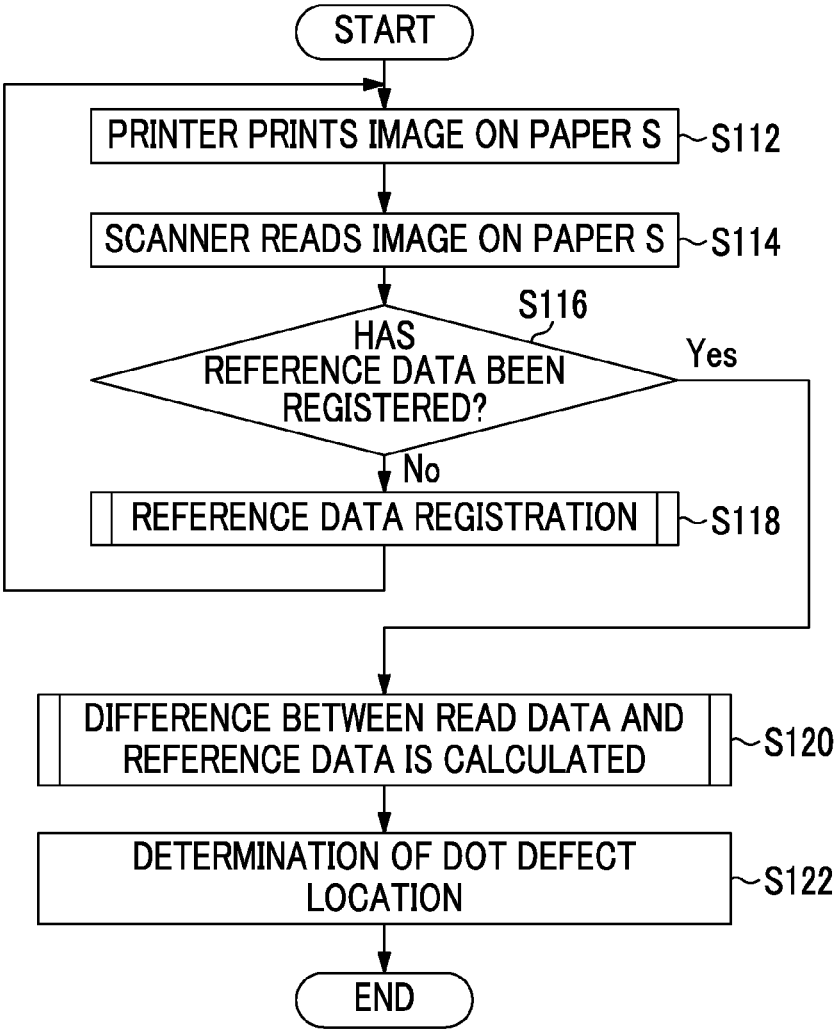
FIG. 3 is a flowchart showing the procedure of detecting a discharge defect.

FIG. 3 is a flowchart showing the procedure of detecting a discharge defect. First, an image is printed on paper S by the printer 12 (step S112). The printer 12 prints, on the paper S, an actual image, which is recorded in an image region based on the image data indicating the image content designated as an image to be printed. The printer 12 also prints, on the paper S, vertical linear marks, which is recorded in a margin other than the image region, by nozzles of predetermined nozzle numbers set in advance (refer to FIG. 8).

Then, the printed image is read by the scanner 20 (step S114), and the read data of the image formed on the paper S is generated. In addition, among the data items acquired by the scanner 20, the image region where the actual image is recorded and the region of the margin where the marks are recorded may be distinguished and data processing may be performed for each targeted region.

Then, the process proceeds to step S116 to determine whether or not data of a reference image (referred to as "reference data") used for the determination of a discharge defect is registered. When the reference data with respect to the printed image is not registered, the process proceeds to step S118 to perform reference data registration process. After outputting the image read by the scanner 20 from the printer 12, data of the read image is registered as reference data after the user visually confirms that there is no problem in the print of the image.

The reference data may be registered by performing test printing before executing a printing job for drawing and outputting a large number of images to be printed. Alternatively, the printing job may be started once, and thereafter the first or subsequent sheets of the printed paper may be visually checked to determine whether the quality satisfactory. In a case where the quality is determined to be satisfactory, the read image of the target image may be registered as reference data.

Figure 4:
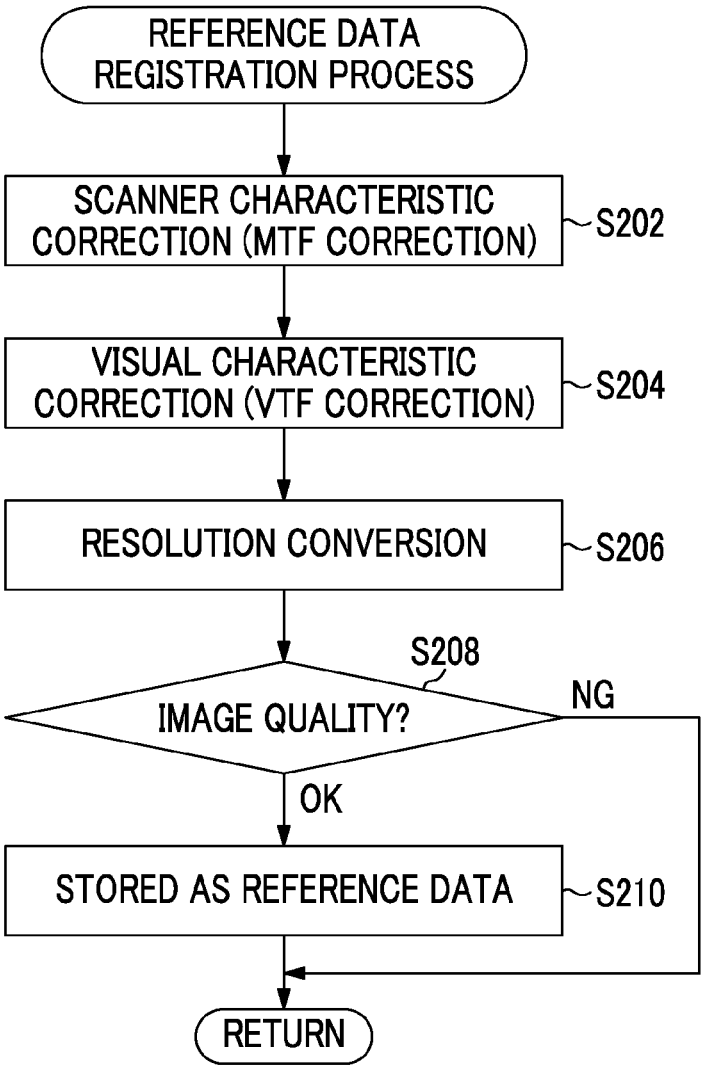
FIG. 4 is a flowchart showing the procedure of the process of registering the reference data.

FIG. 4 is a flowchart of the reference data registration process. When this process starts, first, processing for correcting the scanner characteristics for the image data acquired through the scanner 20 (scanner characteristic correction processing) is performed (step S202). In the read image data that is read by the scanner 20, resolution degradation due to the reading occurs depending on the performance (scanner characteristics) of the scanner 20. Generally, in the MTF (Modulation Transfer Function) frequency characteristic $F_{MTF}$ of the scanner, the response is reduced on the high frequency side. Accordingly, conversion for the compensation for the reduced frequency (correction processing) is performed.

Figure 5:
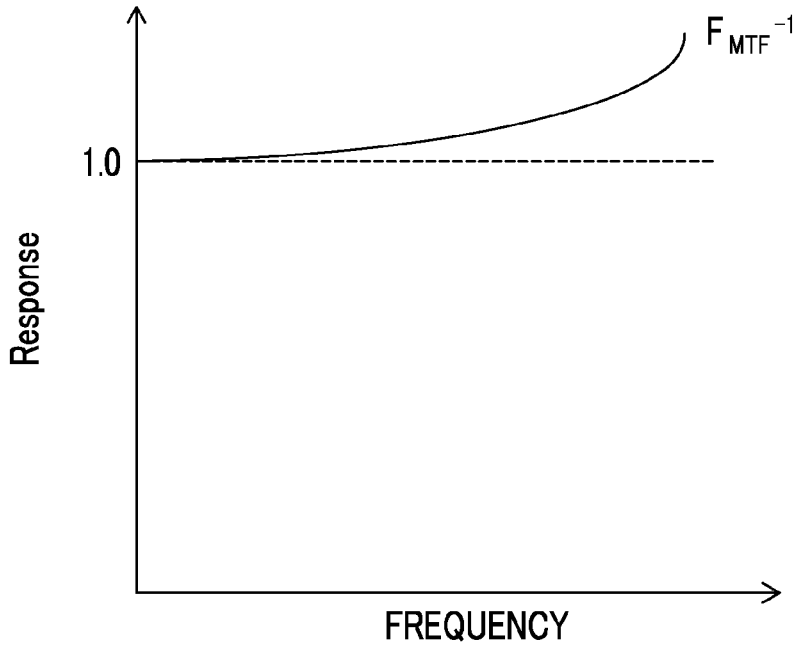
FIG. 5 is a view showing an example of a correction function for scanner characteristic correction.

FIG. 5 shows an example of the function ($F_{MTF}^{-1}$) used for frequency characteristic correction (MTF correction). As shown in FIG. 5, the correction function is a function that performs correction to increase the response on the high frequency side. The MTF correction is performed by applying such a function.

Then, visual characteristic correction (VTF correction) is performed in consideration of the spatial frequency characteristics (VTF; Visual Transfer Function) of human vision (step S204 in FIG. 4). In usual printing purposes, there may be no problem, if there is no difference or defects in the printing images that a person is capable of recognize (i.e., if they cannot be perceived as a defect by a person). Therefore, a kind of low pass filter (VTF) is applied in accordance with the human visual characteristics $F_{VTF}$.

Figure 6:
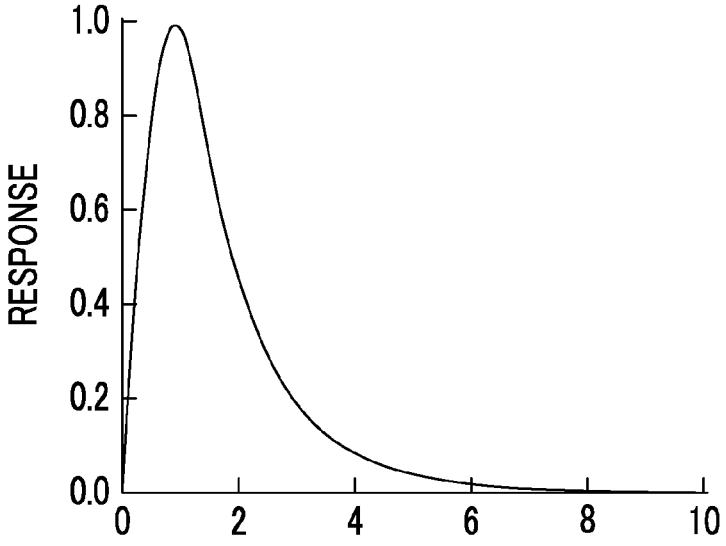
FIG. 6 is a graph showing the human visual characteristics.

FIG. 6 shows an example of the human visual characteristics. The horizontal axis indicates a spatial frequency (cycles/millimeter), and the vertical axis indicates a response. The horizontal axis indicates a relative value when the maximum value of response sensitivity is normalized as "1". Human vision is a maximum sensitivity (referred to as "1") in the vicinity of the spatial frequency of 0.8 cycles/millimeter (c/mm), for example. The response when the spatial frequency is 2 cycles/millimeter (c/mm) is about 0.4. Then, the response rapidly drops according to an increase in the spatial frequency, and becomes approximately zero when the spatial frequency is 6 to 8 cycle/millimeter.

The model of such spatial frequency human visual characteristics is disclosed in detail in "Design of minimum visual modulation halftone patterns, IEEE Trans. Syst. Man Cybern., vol 121, No. 1, 33-38 (1991)" written by author J. Sullivan, L. Ray, and R. Miller. By converting image data by applying a low pass filter corresponding to the human visual characteristics, even if high-frequency unevenness that is not visible to human beings occurs, the high-frequency unevenness is no longer determined as a discharge defect.

For the above-described reason, processing expressed by the following Expression 1 is performed on each line of the read data. "Each line" referred to herein means each pixel row aligned in a read line width direction (equivalent to the "paper width direction") of the scanner 20.

$$\text{Img_ref_mod 1}(i,n)=F_{VTF}\{F_{MTF}^{-1}(\text{Img_scan_ref}(i,n))\} \quad \text{Expression 1:}$$

The meaning of the symbols in Expression 1 is as follows.

Img_ref_mod 1 indicates image data of reference data in the reading resolution.

Img_scan_ref(i, n) indicates an image read by the scanner, that is, data before various kinds of correction processing on the read data as a reference image.

i indicates a pixel number of each row of photoelectric conversion elements (CCD; charge-coupled device) aligned along the read line width direction of the scanner 20.

n indicates the number of read lines in the raster direction (paper feed direction).

Each filtering process expressed by the functions of $F_{VTF}(u)$ and $F_{MTF}^{-1}(u)$ in Expression 1 may be a multiplication in frequency space or may be a convolution operation in real space. In addition, $F_{MTF}^{-1}$, which is equivalent to the scanner characteristic correction (MTF correction), may be omitted, if the scanner 20 is capable of perform reading with high accuracy (high resolution).

Then, the process proceeds to step S206 in FIG. 4 to perform a resolution conversion process for converting the image data have a nozzle resolution of the printer 12 as a result of the visual characteristic correction (step S204). In a discharge defect determination process to be described later, whether there is a defect or not is determined for each nozzle. Accordingly, a conversion process to causing the read image data to have a nozzle resolution of the printer 12 is required.

Figure 7:
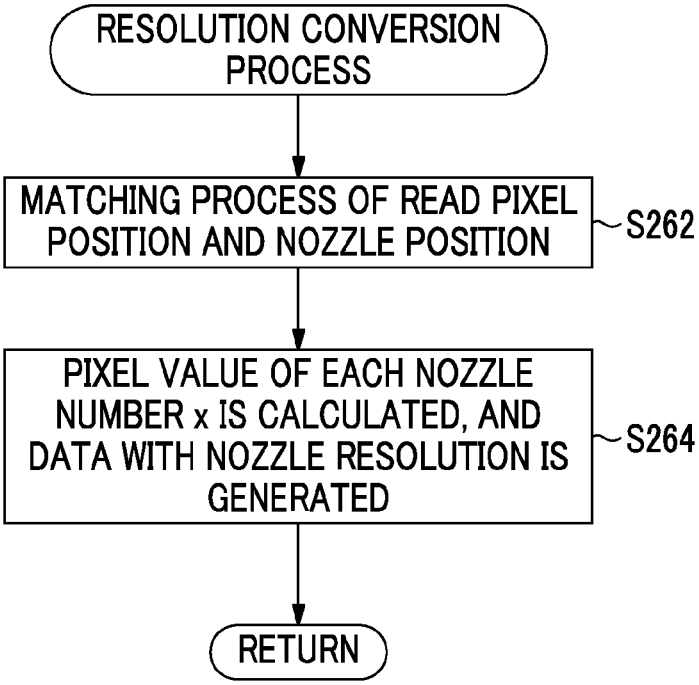
FIG. 7 is a flowchart showing the procedure of the resolution conversion process.

As shown in FIG. 7, this resolution conversion process (step S206) includes a processing step of performing the matching between the read pixel position of the scanner 20 and the nozzle position (equivalent to step S262 and a "nozzle position matching step") and a step of generating data in nozzle resolution by calculating the pixel value of each nozzle number x using the obtained matching relationship (step S264).

In the ink jet printer that performs drawing in a single pass method, when printing out a large number of sheets of paper, it is necessary to correct the relationship between the nozzle position and the read pixel position that indicates which nozzle has been used to draw each image on each paper.

A paper position may be shifted ("skew" is included) due to unevenness at the time of paper transport. Further, paper may be expanded due to the difference in the amount of ink (difference in the amount of water) applied onto the paper in accordance with the image density at the time of drawing, and thereby the image may expand or contract. In order to correct such misalignment, image expansion or contraction, or the distortion of the optical system itself of the scanner, a mark is drawn in the margin of the paper for the output image using a predetermined nozzle, and this mark is read by the scanner 20. In this manner, matching between a pixel of the imaging device that has read the mark and the nozzle number that has drawn the mark can be performed.

Figure 8:
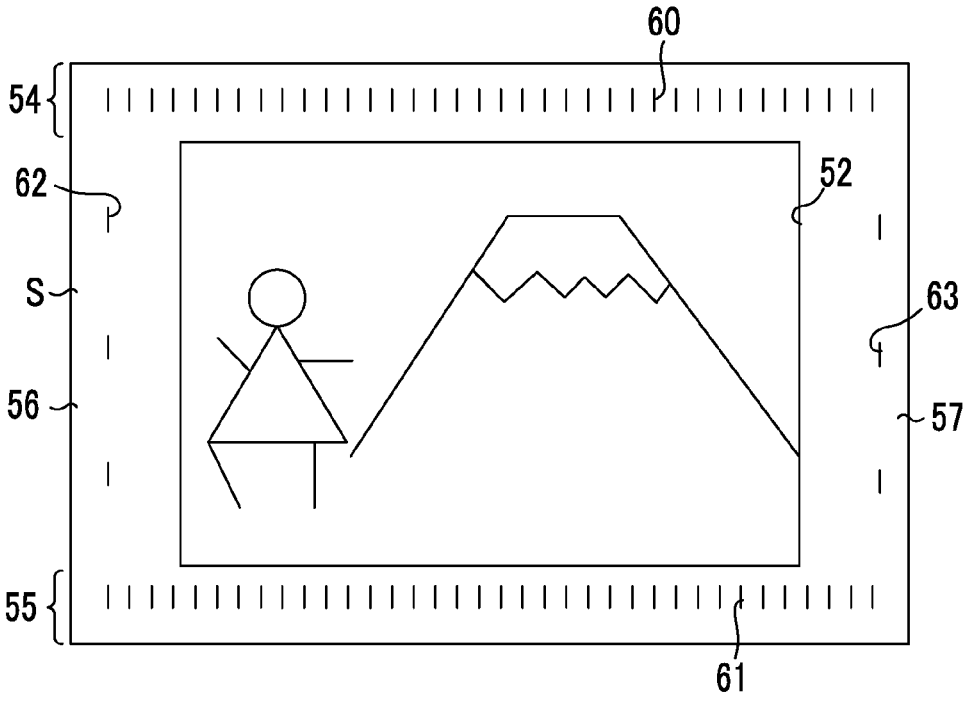
FIG. 8 is a view showing examples of an image and a mark for nozzle position matching recorded on paper.

FIG. 8 shows the example. As shown in FIG. 8, in an upper margin 54 outside an image region 52 (actual image portion) on the paper S, a linear mark 60 is recorded by the nozzle of the nozzle number set in advance. In addition, in FIG. 8, the paper S is assumed to be transported from bottom to top. Nozzle numbers that record the marks 60 used for references for matching the nozzle position with the read pixel position are set in advance at fixed intervals in the nozzle alignment direction (nozzle row direction) of the substantial nozzle row of the head 38, for example, as No. 0, No. 1000, No. 2000, . . . .

In the arrangement of a plurality of marks 60 recorded in this case, each mark 60 is distinguished by giving the mark number k (where k is an integer) from one end on the paper S (for example, the left end in FIG. 8). Then, the nozzle number Index_nozzle(k) that writes the k-th mark is expressed as a sequence set of multiples of 1000, for example, as 0, 1000, 2000, 3000 . . .

That is, Index_nozzle(k)={0, 1000, 2000, 3000, . . . } is set in advance as a nozzle number that draws a mark.

The read pixel number that reads the k-th mark in the read pixel row of the scanner is assumed to be Index_CCD(k, 1). Here, the upper margin is set to n=1. Index_CCD(k, n) can be calculated by extracting the mark position from the image Img_scan_ref(i, n) read by the scanner and then by calculating the edge position from the extract image, and thereby be calculating which pixel of the read image corresponds to the mark position.

Where the image data of the reference data converted to have an output nozzle resolution is Img_ref_mod 2(x, n), the pixel value of each nozzle number x is calculated as follows.

First, "k1" satisfying Index_nozzle(k1−1)≤x<Index_nozzle(k1) is calculated.

Linear interpolation of the above-described mark position may be used for the magnification.

Where the ratio p of an interior division is expressed by the following Expression 2, the reference data to which the nozzle resolution conversion has been performed is expressed by the following Expression 3.

$$p=\{x-\text{Index_Nozzle}(k1-1)\}/\{\text{Index_Nozzle}(k1)-\text{Index_Nozzle}(k1-1)\} \quad \text{Expression 2:}$$

$$\text{Img_ref_mod 2}(x,n)=\text{Img_ref_mod 1}(\text{Index_CCD}(p,1),n) \quad \text{Expression 3:}$$

Here, in a case where p is treated not as an integer but as a real number, Index_CCD(p, n) can be calculated by interpolation using integral values before and after p.

Depending on the accuracy of the relative movement of the paper S with respect to the head 38, an additional mark 61 may be drawn by the nozzle of Index_CCD(k, n) at the last of the image in the raster direction (i.e., in a lower margin 55 of the paper S in FIG. 8).

In this case, Index_CCD(k, N) is calculated in the same manner as Index_CCD(k, 1). Index_CCD(k, N) is a read pixel number that reads the k-th mark, and the printing region of the mark 61 of the lower margin 55 is expressed as n=N. By recording the same marks 60 and 61 in the upper and lower margins 54 and 55 outside the image region 52 as described above, a mark read pixel number Index_CCD(k, n) in the n-th column in the raster direction can be set using the following Expression 4.

$$\text{Index_CCD}(k,n)=\{n\times\text{Index_CCD}(p,1)\}+\{(1-n)\times\text{Index_CCD}(p,N)\}. \quad \text{Expression 4:}$$

In addition, marks 62 and 63 may also be put in left and right margins 56 and 57 of the paper S. By performing correction using Index_CCD(1, q) and Index_CCD(N, q) by using these marks 62 and 63, the accuracy can be further improved. That is, if the marks 62 and 63 are used, variations in a direction (direction of the subscript i) perpendicular to the paper feed direction that occur during paper feed can be corrected by using Index_CCD(1, q), Index_CCD(N, q), and Expression 4. Since the correction using two points is performed, magnification interpolation is performed to fit the start point and the end point.

Where Index_CCD calculated by Expression 4 is expressed as Index_CCD_cal4, Index_CCD of the q column can be calculated as Index_CCD_cal4(*k, q*)={q×Index_CCD(p, 1)}+{(1−q)×Index_CCD(p, N)}.

Where Index_CCD obtained by correcting Index_CCD calculated by Expression 4 using Index_CCD(1, q) and Index_CCD(N, q) is expressed by Index_CCD_cal5, interpolation can be performed by the following Expression 5.

$$\text{Index_CCD_cal5}(k,q)=\{\text{Index_CCD_cal4}(k,q)-\text{Index_CCD_cal4}(1,q)\}\times\{(\text{Index_CCD}(N,q)-\text{Index_CCD}(1,q))/(\text{Index_CCD_cal4}(N,q)-\text{Index_CCD_cal4}(1,q))\}. \quad \text{Expression 5:}$$

Also for the arbitrary n column, Index_CCD can be calculated by Expression 5 using Index_CCD_cal(1, n)={(n−q1)×Index_CCD(1, q2)+(q2−n)×Index_CCD(1, q2)}/(q2−q1) and Index_CCD_cal(N, n)={(n−q1)×Index_CCD(N, q2)+(q2−n)×Index_CCD(N, q2)}/(q2−q1) that are the ratios of the values of q1 and q2 columns closest to the n column.

Figure 9:
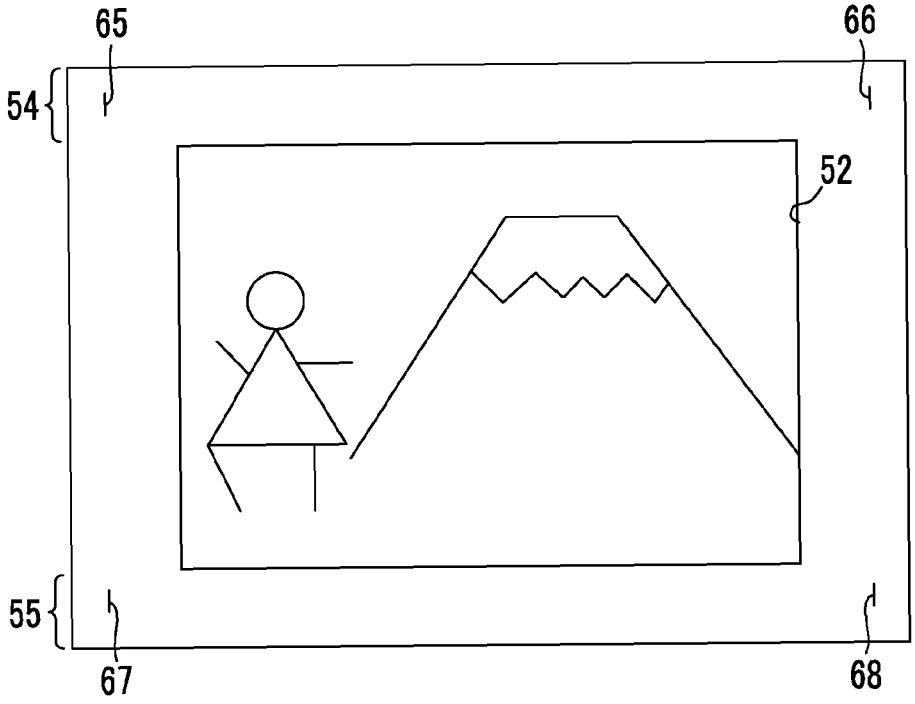
FIG. 9 is a view showing another example of the mark for nozzle position matching recorded on paper.

The way of recording the marks 60 to 63 outside the image region 52 of the paper S may vary depending on the accuracy of the relative positions of the paper S and the nozzle. Therefore, as shown in FIG. 8, many marks 60 to 63 may be recorded in the margin. Alternatively, in a case where the accuracy of the relative positions of the paper S and the nozzle is high, the number of marks may be reduced, for example, marks may be put only in four corners of the paper S as shown in FIG. 9. In addition, in a case the accuracy of the relative positions of the paper S and the nozzle is good and the reproducibility is high, Index_CCD may be calculated in advance and marks may be omitted from the image. In general, however, the reproducibility or accuracy of the relative position is not necessarily high. Therefore, a configuration is preferable in which marks are put as in the present embodiment to specify the correspondence relationship between the nozzle position and the pixel position.

Reference data Img_ref_mod 2 converted to have a nozzle resolution is generated by performing the process described above (steps S202 to S206 in FIG. 4).

Then, the process proceeds to step S208 in FIG. 4 to check the quality of the print of the read image by visual observation. When the user determines that there is no problem in the quality, an instruction of "visually good" (OK) is input through an appropriate GUI (Graphical User Interface) or the like. When the user inputs the instruction of "visually good" (OK), the process proceeds to step S210 in which the data after the nozzle resolution conversion generated in step S206 is stored as reference data.

On the other hand, if an image defect is found when checking the print visually, an instruction of an image defect (NG) is input through the appropriate GUI. In this case, the determination in step S208 is NG. Accordingly, reference data storage processing (step S210) is skipped to return to the main flow (FIG. 3). In a case the reference data storage processing (step S210) is not performed, the same processing (steps S112 to S118 in FIG. 3) is performed for the next reading image. In a case where the reference data storage processing is not performed, it is usual that steps S112 to S118 be performed again after performing certain image quality improvement processing (for example, nozzle maintenance work) not shown in FIG. 3.

Thus, in the reference data registration process, the user observes a print visually to determine whether or not there is a problem, and the registration (storage processing) of the reference data is performed when the user inputs an instruction of OK through the appropriate GUI. The process of steps S202 to S210 in FIG. 4 may be started after the user inputs OK based on visual determination. Alternatively, a display asking for the input of OK (register)/NG (cancel) may be given on the GUI screen or the like after the process of steps S202 to S206, and the registration process may be executed/canceled in response to the user's selection using a GUI button.

When the registration of the reference data is completed, the determination in step S116 of FIG. 3 is YES, and the process proceeds to step S120. In step S120, arithmetic processing to calculate a difference between the read data of the newly printed image and the reference data is performed. Then, based on this difference calculation result, determination of a dot defect location (discharge-defective nozzle) is performed (step S122).

Figure 10:
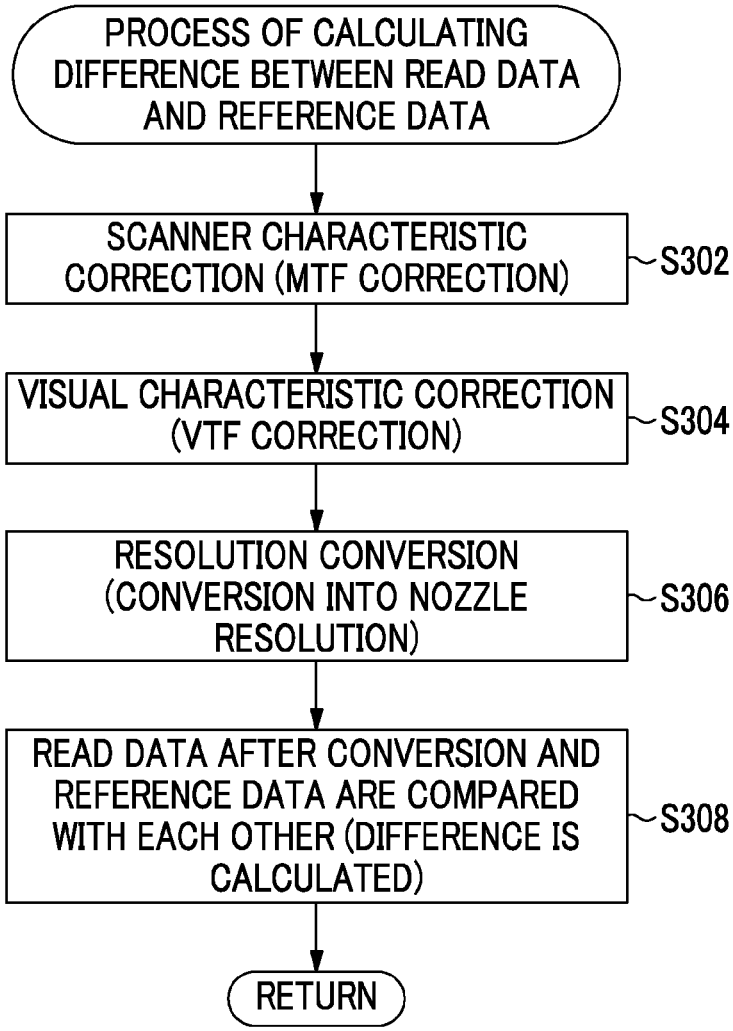
FIG. 10 is a flowchart showing the procedure of the process of calculating the difference between the read data and the reference data.

FIG. 10 is a flowchart showing the procedure of the process of calculating the difference between the read data and the reference data. As shown in FIG. 10, for the read data that has been read by the scanner 20, scanner characteristic correction (MTF correction) (step S302) and visual characteristic correction (VTF correction) (step S304) are performed, and resolution conversion (step S306) into the nozzle resolution is further performed. These processes (steps S302 to S306) are the same as steps S202 to S206 in FIG. 4 and the processing content described in FIG. 7.

Assuming that the image data (data after correction) having a reading resolution obtained through the scanner characteristic correction (step S302) and the visual characteristic correction (step S304) is Img_mod 1, Img_mod 1 is expressed by the following Expression 6.

$$\text{Img_mod 1}(i,n)=F_{VTF}\{F_{MTF}^{-1}(\text{Img_scan}(i,n))\} \quad \text{Expression 6:}$$

The meaning of the symbols in Expression 6 is as follows.

Img_scan (i, n) indicates an image read by the scanner, that is, data before various kinds of correction processing on the read data.

i indicates a pixel number of each row of photoelectric conversion elements (CCD; charge-coupled device) aligned along the read line width direction of the scanner 20.

n indicates the number of read lines in a raster direction (paper feed direction) that have been read in the coarse resolution.

By reading an image with a scanner, two-dimensional image data (read data) in which the image position is specified by (i, n) is obtained. Each filtering process expressed by the functions of $F_{VTF}(U)$ and $F_{MTF}^{-1}(u)$ in Expression 5 may be a multiplication in frequency space or may be a convolution operation in real space. In addition, $F_{MTF}^{-1}$, which is equivalent to the scanner characteristic correction (MTF correction), may be omitted in a case where the scanner 20 is capable of performing reading with high accuracy (high resolution).

In addition, where the image data having the nozzle resolution obtained through the resolution conversion (step S306) is Img_mod 2 (x, n), Img_mod 2 (x, n) is expressed by the following Expression 7.

$$\text{Img_mod 2}(x,n)=\text{Img_mod 1}(\text{Index_CCD}(p,1),n) \quad \text{Expression 7:}$$

According to Expression 7, each pixel data item at the image position (x, n) specified by the nozzle position x and the line number n can be calculated.

In this manner, the read data the reference data having a resolution equivalent to the nozzle resolution and are prepared.

Then, a difference between data (reference data) of the reference image registered in advance and the read image is calculated (step S308 in FIG. 9). Specifically, the absolute value Img_diff(x, n) of the difference is calculated by the following Expression 8.

$$\text{Img_diff}(x,n)=|\text{Img_mod 2}(x,n)-\text{Img_ref_mod 2}(x,n)| \quad \text{Expression 8}$$

Such a comparison (difference calculation) may performed for each read column in a range of n=1 to N.

In the case of Img_diff(x, n)=0, it can be determined that the image is almost ideal and there is no defect. If there is a defect, there is a difference. Since a reading error and an image conversion error are also included in the difference, the difference is not necessarily 0. In the present embodiment, since defect determination is performed for each nozzle, an integrated value of the difference is calculated for each nozzle number x, and determination of a defective nozzle is performed by determining whether or not the integrated value exceeds a predetermined value (threshold value α) (step S122 in FIG. 3).

The integrated value $\text{Img_diff}_{_sum}(x)$ of the difference for each nozzle number x is expressed by the following Expression 9.

$$\text{Img_diff}_{_sum}(x)=\Sigma_n\text{Img_diff}(x,n) \quad \text{Expression 9:}$$

In a case the integrated value $\text{Img_diff}_{_sum}(x)$ of this difference satisfies the inequality of the following expression Expression 10, the nozzle x is determined to be a defective nozzle.

$$\text{Img_diff}_{_sum}(x)>\alpha \quad \text{Expression 10:}$$

In addition, the threshold value may also be set to determine the nozzle x to be a defective nozzle in a case where the integrated value $\text{Img_diff}_{_sum}(x)$ is equal to the threshold value α.

<Regarding a Process after Detecting a Defective Nozzle>

In a case where the nozzle is determined to be defective, printing may be stopped first to perform nozzle maintenance work. Alternatively, printing may be stopped first to perform correction processing (defective nozzle correction) for correcting an image defect due to a defective nozzle, or this correction processing may be performed without stopping the printing. A defective nozzle correction function is a known method in the ink jet field. For example, the output of a defective nozzle may be corrected using a nozzle in the vicinity of the defective nozzle. For the defective nozzle correction function, techniques disclosed in JP2011-126208A, JP2006-347164A, and the like may be applied.

Generally, the degree of a nozzle defect may be determined using the droplet landing position error of a nozzle. However, it is difficult to determine a defect based on the droplet landing position. Depending on the output pattern (density of color=droplet ejection rate), stripe unevenness may not occur with the same position error. In the case of an apparatus that determines a defect based on the droplet landing position, a situation has occurred many times in which there is little effect when outputting an actual image even if a defect is determined at the droplet landing position.

In this regard, according to the present embodiment, a configuration is adopted in which the image quality in an actual output image is determined by applying the visual characteristics (VTF) to the actual output image. For this reason, the quality of an image can be reliably determined, and the execution of unnecessary maintenance work or correction work can be avoided.

<Regarding Correction Processing after Specifying a Defective Nozzle>

FIRST EXAMPLE

Discharge Defect Correction Method

As a defective nozzle correction method, for example, known correction means disclosed in JP2011-126208A may be used. This method makes it enable to correct the stripe unevenness due to a non-discharging nozzle. JP2011-126208A discloses the image processing apparatus [1] to [6] having the following configuration.

[1] An image processing apparatus including: output characteristic storage means for storing an output characteristic with respect to an input for each recording element of a recording head that moves relative to a medium to be recorded and has a plurality of recording elements; recording defect information acquisition means for acquiring recording defect information regarding a recording-defective element, which is a recording-defective recording element among the plurality of recording elements; density correction value storage means for storing a density correction value for reducing an influence of a defective pixel, which is caused by the recording-defective element, on an output image; image data acquisition means for acquiring input data; image data specification means for specifying data of pixels corresponding to adjacent recording elements, which record adjacent pixels of a pixel corresponding to the recording-defective element, from the acquired input data; recording density calculation means for calculating a recording density for the specified data using output characteristics of the adjacent recording elements stored in the output characteristic storage means; and image data correction means for correcting the specified data so that a recording density obtained by adding the calculated recording density and the density correction value becomes a recording density after correction.

[2] In the image processing apparatus described in [1], the output characteristic storage means stores a characteristic curve showing a recording density for input data for each recording element of the recording head.

[3] In the image processing apparatus described in [1] or [2], the density correction value storage means stores a density correction value for each recording color, and the image data correction means corrects the specified data using the density correction value corresponding to the recording color of the recording-defective element.

[4] In the image processing apparatus described in any one of [1] to [3], the density correction value storage means stores a density correction value for each type of the medium to be recorded, and the image data correction means corrects the specified data using the density correction value corresponding to the type of the medium to be recorded.

[5] In the image processing apparatus described in any one of [1] to [4], means for detecting a distribution of the recording-defective element based on the recording defect information is further provided, the density correction value storage means stores a density correction value corresponding to the distribution of the recording-defective element, and the image data correction means corrects the specified data using the density correction value corresponding to the distribution of the detected recording-defective element.

[6] In the image processing apparatus described in [5], the density correction value changes according to whether or not the specified data is data of pixels corresponding to adjacent recording elements between recording-defective elements.

According to the method disclosed in JP2011-126208A, a non-discharging nozzle is specified, and a correction coefficient that corrects image data so as to compensate for the density of the non-discharging nozzle using surrounding nozzles other than the non-discharging nozzle is calculated.

Using the correction data, image data correction is performed for the input image data for printing.

This image data correction processing is preferably performed on the continuous tone image data before halftone processing (processing for conversion into binary or multi-level dot data).

SECOND EXAMPLE

An Example of an Unevenness Correction Method

As a defective nozzle correction method, for example, known correction means disclosed in JP2006-347164A may be used. This method can correct the density unevenness due to droplet landing error. JP2006-347164A discloses the image recording apparatus [1] to [8] having the following configuration.

[1] An image recording apparatus comprising: a recording head having a plurality of recording elements; transport means for moving the recording head and a medium to be recorded relative to each other by transporting at least one of the recording head and the medium to be recorded; characteristics information acquisition means for acquiring information indicating a recording characteristic of the recording element; determination means for determining a recording element to be corrected, for which density unevenness due to the recording characteristic is to be corrected, among the plurality of recording elements; correction range setting means for setting N (where N is an integer of 2 or more) correction recording elements, which are used for correction of output density, among the plurality of recording elements; correction coefficient determination means for calculating density unevenness due to the recording characteristic of the recording element to be corrected and determining a density correction coefficient of the N correction recording elements based on a correction condition for reducing a low-frequency component of a power spectrum showing spatial frequency characteristics of the density unevenness; correction processing means for performing an operation to correct the output density using the density correction coefficient determined by the correction coefficient determination means; and driving control means for controlling driving of the recording element based on the correction result of the correction processing means.

[2] In the image recording apparatus described in [1], the correction condition is a condition in which a differential coefficient at a frequency origin (f=0) of the power spectrum showing the spatial frequency characteristics of density unevenness is approximately 0.

[3] In the image recording apparatus described in [2], the correction condition is expressed as N simultaneous equations obtained by the storage condition of a DC component of the spatial frequency and the condition in which the derivatives up to the (N−1) order become approximately 0.

[4] In the image recording apparatus described in any one of [1] to [3], the recording characteristic is a recording position error.

[5] In the image recording apparatus described in [4], assuming that an index for specifying a position of the recording element is i and a recording position of the recording element i is xi, a density correction coefficient di of the recording element i is determined by the following expression.

$$d_i = \begin{cases} \dfrac{\prod_k x_k}{x_i \cdot \prod_{k \neq i} (x_k - x_i)} - 1 & \text{(recording element to be corrected)} \\ \dfrac{\prod_k x_k}{x_i \cdot \prod_{k \neq i} (x_k - x_i)} & \text{(other than recording element to be corrected)} \end{cases}$$

[6] In the image recording apparatus described in [1] or [2], storage means for storing a print model of the recording element is further provided, and the correction coefficient determination means determines the correction coefficient based on the print model.

[7] In the image recording apparatus described in [6], change means for changing the print model based on a recording state of the recording element is further provided.

[8] In the image recording apparatus described in [6] or [7], the print model is a semi-sphere model.

Non-uniformity of the density (density unevenness) in the recorded image can be expressed by the intensity in the spatial frequency characteristics (power spectrum), and the visibility of density unevenness can be evaluated by the low-frequency component of the power spectrum. For example, the intensity of the power spectrum becomes minimum at the frequency origin (f=0) by determining the density correction coefficient using the conditions in which the derivative at the frequency origin of the power spectrum after correction using the density correction data becomes approximately 0. Accordingly, the power spectrum in the vicinity of the origin (that is, in the low-frequency region) can be reduced. In this manner, accurate unevenness correction can be realized.

Using the correction method disclosed in JP2006-347164, density correction coefficients corresponding to a nozzle to be corrected and nozzles included in the correction range near the nozzle to be corrected are calculated. The density unevenness due to the recording characteristics (droplet landing error or the like) of a nozzle is calculated, and density correction data is calculated based on the correction condition to reduce the low-frequency component of the power spectrum showing the spatial frequency characteristics of the density unevenness. Using the density correction data, image data correction is performed for the input image data for printing.

This image data correction processing is preferably performed on the continuous tone image data before halftone processing (processing for conversion into binary or multi-level dot data).

In addition, the discharge defect correction method disclosed in JP2011-126208A and the unevenness correction method disclosed in JP2006-347164A may be combined. The discharge defect correction method and the unevenness correction method introduced in JP2011-126208A and JP2006-347164A are just examples. Various known techniques may be used and combined as stripe unevenness or nozzle defect correction methods in a single-pass type ink jet printer, such as a method of performing correction by changing the correction nozzle discharge method to change the drop volume instead of performing correction processing on the image data in the case of the discharge defect correction method and a method of reading the image density of a test chart and correcting the unevenness according to the read image density in the case of the unevenness correction method.

<Functional Block Diagram of the Image Processing Apparatus>

Figure 11:
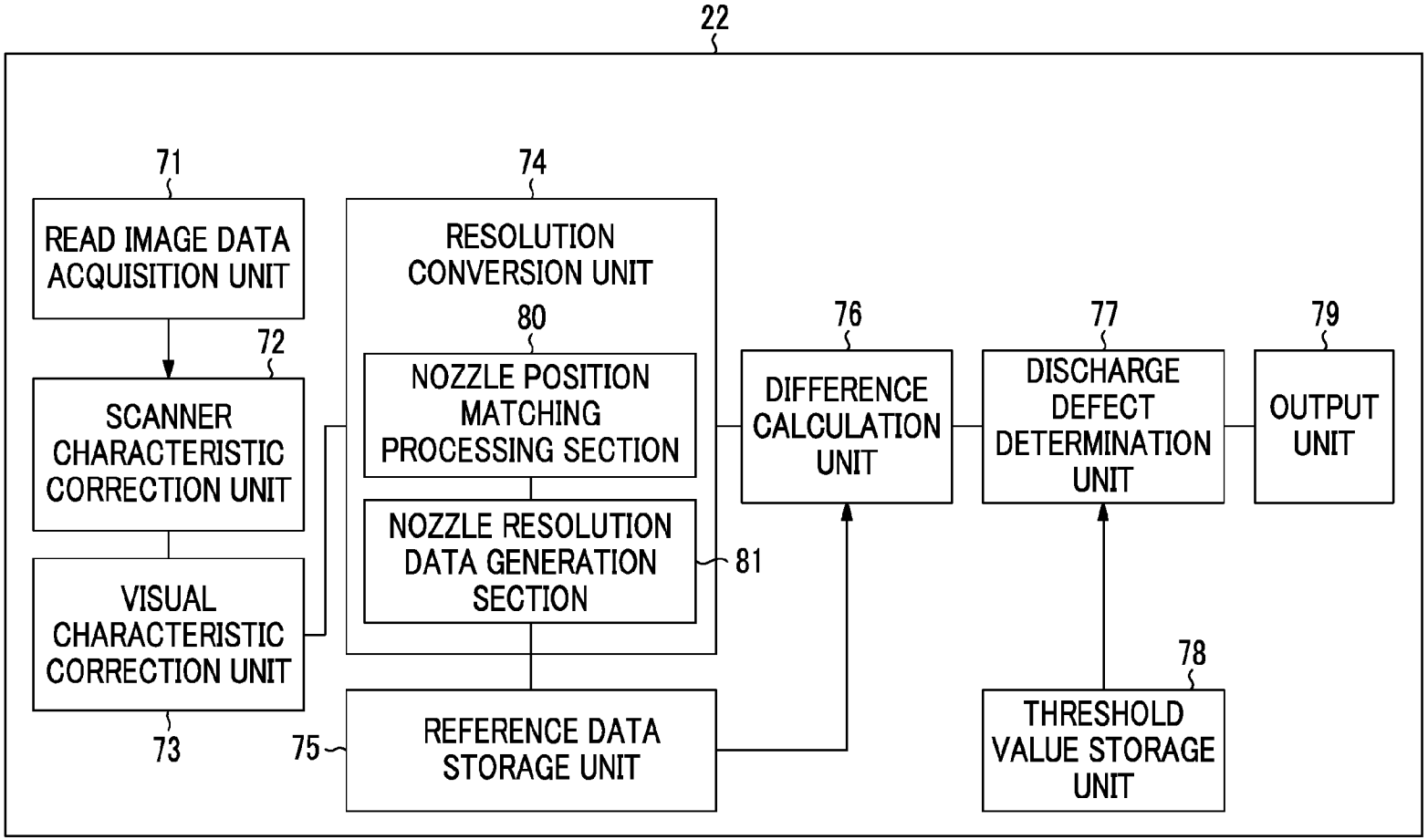
FIG. 11 is a block diagram showing the functional configuration of an image processing apparatus.

FIG. 11 shows a functional block diagram of the image processing device 22 according to the present embodiment. As shown in FIG. 11, the image processing device 22 includes an read image data acquisition unit 71, a scanner characteristic correction unit 72, a visual characteristic correction unit 73, a resolution conversion unit 74, a reference data storage unit 75, a difference calculation unit 76, a discharge defect determination unit 77, a threshold value storage unit 78, and an output unit 79 that outputs the information of the determination result.

The resolution conversion unit 74 is configured to include a nozzle position matching processing section 80 and a nozzle resolution data generation section 81. The read image data acquisition unit 71 includes a connection terminal or a communication interface unit through which data from the scanner 20 (refer to FIG. 1) is acquired.

The scanner characteristic correction unit 72 (equivalent to a "read characteristic correction unit") is a processing unit that performs the scanner characteristic correction processing (equivalent to "read characteristic correction step") described in step S202 of FIG. 4 or step S302 of FIG. 10.

The visual characteristic correction unit 73 is a processing unit that performs the visual characteristic correction processing (equivalent to "visual characteristic correction step") described in step S204 of FIG. 4 or step S304 of FIG. 19. In addition, using an operation function that combines the correction function of the scanner characteristic correction unit 72 and the correction function of the visual characteristic correction unit 73, a configuration that realizes both the correction functions with a single operation is also possible.

The resolution conversion unit 74 is a processing unit that performs the processing for conversion into the nozzle resolution described in step S206 of FIG. 4 or step S306 of FIG. 10. The nozzle position matching processing section 80 is a processing unit that performs the matching processing (equivalent to "nozzle position matching step") described in step S262 of FIG. 7. The nozzle resolution data generation section 81 is a processing unit that performs the processing for generating data having a nozzle resolution described in step S264 of FIG. 7.

The reference data storage unit 75 is storage means for storing the reference data after nozzle resolution conversion generated by the resolution conversion unit 74.

The difference calculation unit 76 is a processing unit that calculates the difference between the reference data and the read data after nozzle resolution conversion described in step S308 of FIG. 10. The discharge defect determination unit 77 is a processing unit that performs determination regarding a defective nozzle by comparison with the threshold value $\alpha$ based on the information of the difference calculated by the difference calculation unit 76. The discharge defect determination unit 77 performs the processing described in step S122 of FIG. 3. The threshold value storage unit 78 is storage means for storing the information of the threshold value $\alpha$ that is used by the discharge defect determination unit 77.

The output unit 79 is a signal output terminal or a communication interface unit through which the information of the determination result of the discharge defect determination unit 77 is output. When a defective nozzle is detected, the information is transmitted to the computer 18 or the controller 32 of the printer 12 and is used for the execution control of the maintenance operation, defective nozzle correction processing, and the like.

<First Modification>

Although the reference data is preferably generated based on the scanning image as described above, data of the reference image (i.e., reference data) may also be generated by performing visual characteristic correction, resolution correction (processing for conversion into nozzle resolution), and γ conversion (adjusting the characteristics of image data and a scanner) for the input image data.

Second Embodiment

In the single-pass type ink jet printer, in order to realize high-quality drawing performance, high resolution corresponding to the nozzle density of 1200 dpi or more is preferable. As described above, it is practically difficult to increase the resolution of the scanner in the paper width direction by twice the resolution of the printer or higher.

Since it is difficult to manufacture one high-resolution line sensor (imaging device) capable of imaging the entire drawing width region of the single pass at once, a plurality of imaging elements having appropriate lengths are prepared and these are connected to each other to realize a desired reading width. In this case, a connection technique for connecting the plurality of imaging elements is required.

Meanwhile, in practice, if a difference between the reference data of a reference image and the read image data is only determined at the time of discharge defect determination, a resolution corresponding to about twice the cut-off frequency of the visual characteristics is sufficient.

From this point of view, in the second embodiment, a scanner having a relatively low resolution corresponding to about twice the cut-off frequency of the visual characteristics (for example, a scanner having a resolution of 600 dpi) is used instead of the scanner 20 in the first embodiment.

Also in the present embodiment, the presence or absence of a defective nozzle can be calculated as in the first embodiment described above. Compared with the first embodiment, the position of a defective nozzle cannot be correctly specified. Accordingly, processing for defective nozzle correction or the like is difficult to perform in this state. However, measures, such as performing recovery (maintenance operation) after detecting the presence or absence of a defective nozzle, can be taken. In this case, the same function as in the first embodiment is possible by low-resolution CCD reading. Since an image reader (scanner) having a lower resolution than the output resolution of a printer can be used in this manner, processing can be performed at high speed and low cost. Such a configuration is sufficient to detect the defect of an image.

Third Embodiment

In the second embodiment, since there is no information of a resolution equal to or higher than the reading resolution of the scanner, the accurate position of a defective nozzle cannot be specified. For this reason, when the position of a defective nozzle needs to be correctly specified for defective nozzle correction processing or the like, a test pattern (nozzle number specification pattern) allowing even the low-resolution scanner to determine a defective nozzle is output (refer to FIG. 12) and the defective nozzle number is specified by analyzing the read image of the test pattern.

Figure 12:
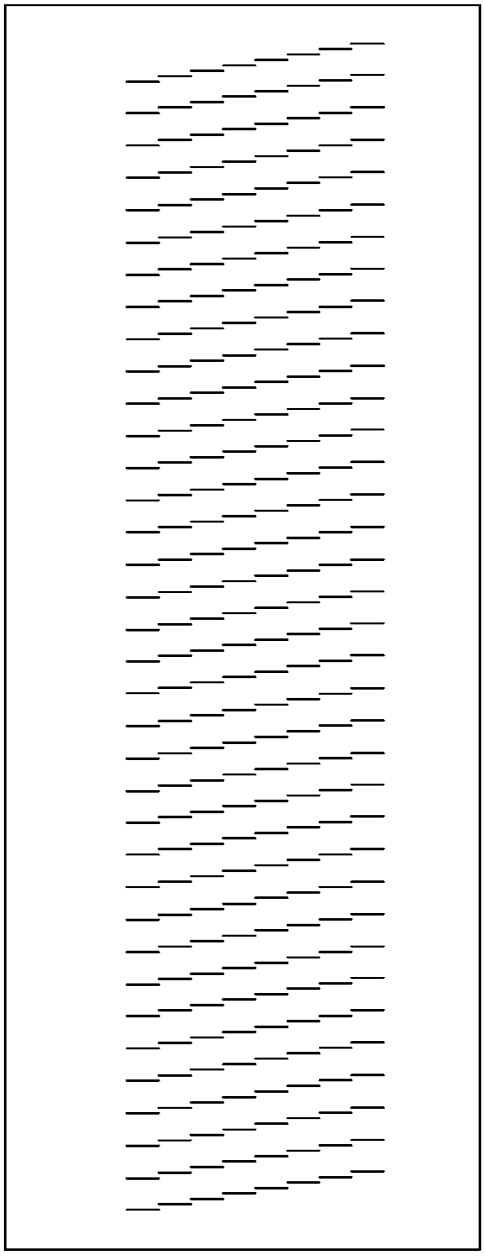
FIG. 12 is a view showing an example of a defective nozzle specifying chart (nozzle number specifying chart).

FIG. 12 shows an example of the nozzle number specification pattern. In the case of the pattern shown in FIG. 12, nozzle numbers used for the recording of the pattern are as follows. In this example, k=8.

Index_nozzle(x, 1)={1, 9, 17, 25, . . . , x−k, x, x+k, . . . }

Index_nozzle(x, 2)=Index_nozzle(x, 1)+1

Index_nozzle(x, 3)=Index_nozzle(x2)+1

Subsequently, similar expressions are possible.

Index_nozzle(x, k)=Index_nozzle(x, k−1)+1

The example shown in FIG. 12 is a so-called 1-ON N-OFF type test pattern for nozzle check, and is an example of N=7. In this example, nozzle groups are divided into eight nozzle groups using remainder values (0 to 7) when the nozzle number x of a substantial nozzle row is divided by 8 and discharge is performed for each group. One vertical line is formed by one nozzle, and the pattern of all nozzles is recorded. No line is present at the position of a non-discharging nozzle, and the line position of a nozzle that causes the shift of the droplet landing position is shifted. When viewed in the nozzle row direction (lateral direction in FIG. 12), such line patterns are discharged at distances of every seven nozzles. Accordingly, the line position can be checked even with a low-resolution scanner. Although the case of N=7 is illustrated herein, the appropriate value of N can be selected depending on the resolution of a scanner.

Figure 13:
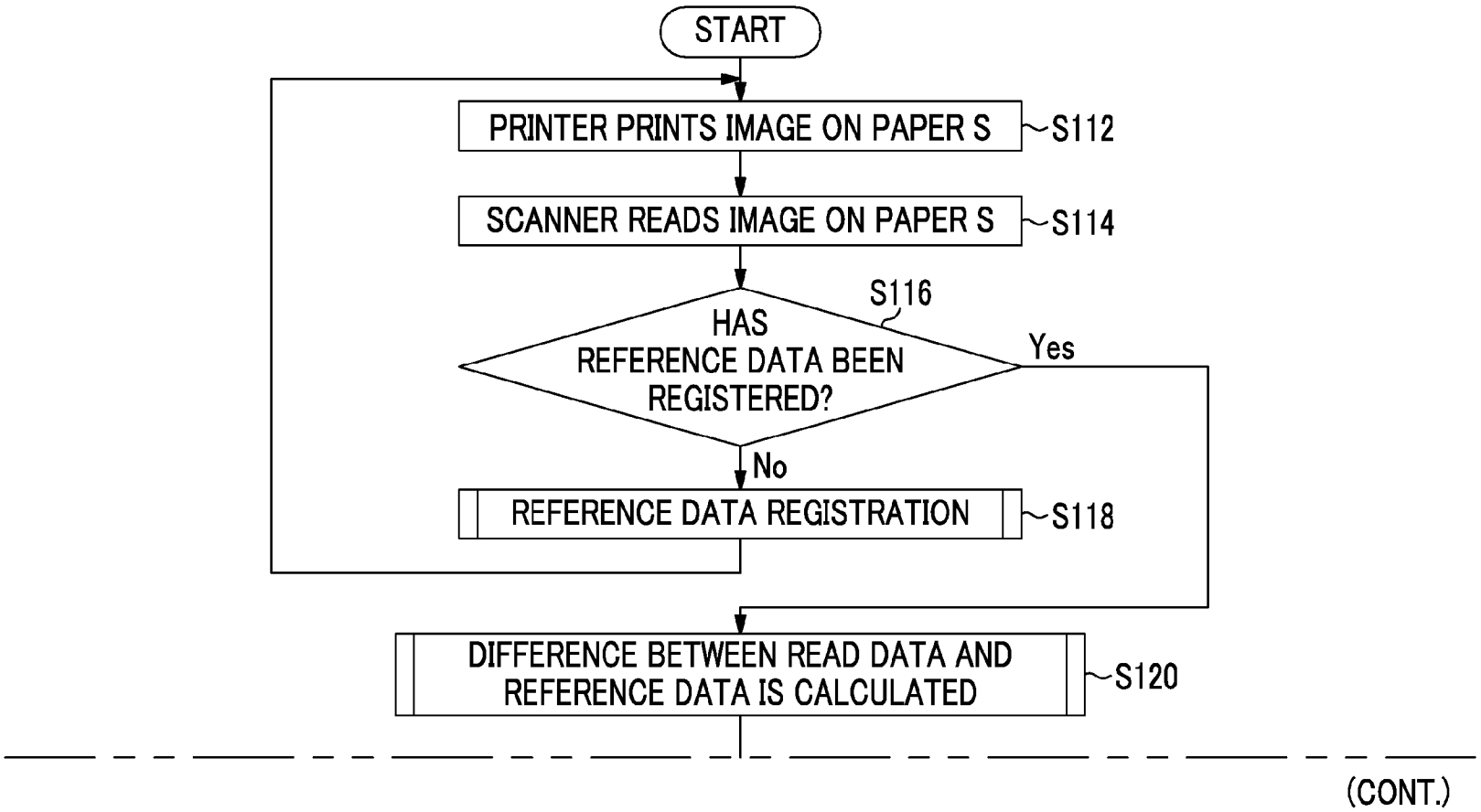
FIG. 13 is a flowchart showing another example of the procedure of detecting a discharge defect.

FIG. 13 shows an example of the flowchart in which the processing for specifying a nozzle number is added using a nozzle number specifying chart. In FIG. 13, the same or similar steps as in FIG. 11 are denoted by the same step numbers, and explanation thereof will be omitted.

As shown in FIG. 13, subsequent to step S122, whether or not a discharge-defective nozzle has been detected is determined (step S124). In a case where a defective nozzle is detected, the process proceeds to step S126 to output a defective nozzle specifying chart (nozzle number specifying chart). This chart is read by the scanner 20, and the position of a discharge-defective nozzle is specified from the read image (step S128).

In a case where a defective nozzle is not detected in step S122, steps S126 to S128 is skipped to end the flow.

<An Example of the Configuration of an Ink Jet Recording Apparatus>

Next, an example of the configuration of an ink jet printing machine will be described as a more specific example of the printing system 10 described in FIG. 1.

Figure 14:
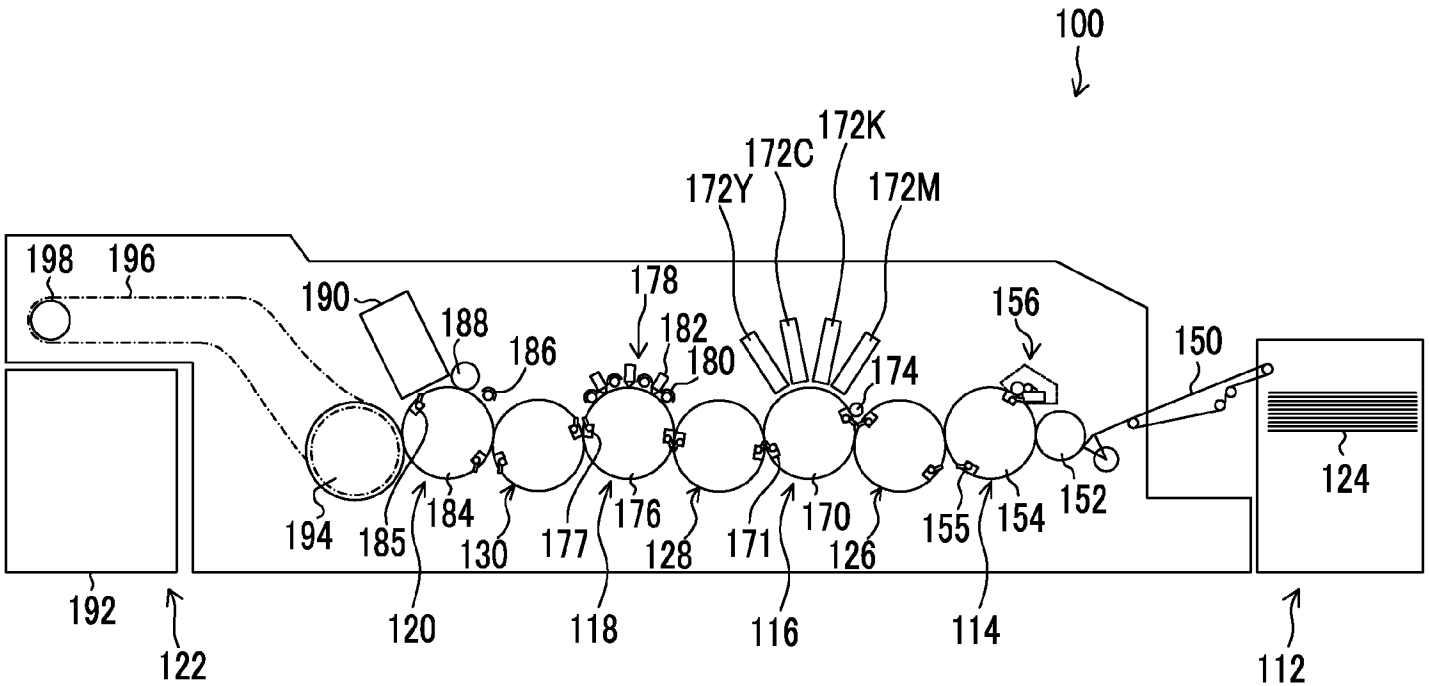
FIG. 14 is a view showing the overall configuration of an ink jet recording apparatus.

FIG. 14 is a view showing an example of the configuration of an ink jet recording apparatus according to the embodiment of the present invention. An ink jet recording apparatus 100 is a printing machine that forms a desired color image by ejecting ink droplets of a plurality of colors from ink jet heads 172M, 172K, 172C, and 172Y on a recording medium 124 (equivalent to a "medium"; hereinafter, may be referred to as "paper" for convenience) held on a drawing drum 170 of a drawing unit 116. In addition, the ink jet recording apparatus 100 is an on-demand type image forming apparatus to which a two-liquid reaction (aggregation) method is applied in which processing liquid (here, aggregation processing liquid) is supplied onto the recording medium 124 before the ejection of ink droplets and the processing liquid and ink liquid are made to react with each other to form an image on the recording medium 124.

As shown in FIG. 14, the ink jet recording apparatus 100 is configured to mainly include a paper feed unit 112, a processing liquid application unit 114, a drawing unit 116, a drying unit 118, a fixing unit 120, and a paper discharge unit 122.

(Paper Feed Unit)

The paper feed unit 112 is a mechanism that supplies the recording medium 124 to the processing liquid application unit 114. The recording medium 124 that is flat paper is stacked on the paper feed unit 112. The recording medium 124 is fed from a paper feed tray 150 of the paper feed unit 112 to the processing liquid application unit 114 one by one. Although the flat paper (cut paper) is used as the recording medium 124 herein, a configuration to feed paper by cutting the required size from continuous paper (roll paper) is also possible.

(Processing Liquid Application Unit)

The processing liquid application unit 114 is a mechanism that applies processing liquid onto the recording surface of the recording medium 124. Processing liquid includes a coloring material aggregation agent that aggregates a coloring material (in this example, pigment) in the ink given by the drawing unit 116. When this processing liquid and ink come in contact with each other, the separation of the coloring material and solvent is promoted.

The processing liquid application unit 114 includes a feed barrel 152, a processing liquid drum 154, and a processing liquid application device 156. The processing liquid drum 154 includes claw-shaped holding means (gripper) 155 on its outer peripheral surface. By making the recording medium 124 interposed between the claw of the holding means 155 and the peripheral surface of the processing liquid drum 154, the tip of the recording medium 124 can be held. A suction hole may be provided on the outer peripheral surface of the processing liquid drum 154, and the processing liquid drum 154 may be connected to suction means for performing suction through the suction hole. In this manner, the recording medium 124 can be held in close contact with the peripheral surface of the processing liquid drum 154.

The processing liquid application device 156 is provided outside the processing liquid drum 154 so as to face the peripheral surface. The processing liquid application device 156 includes a processing liquid container that contains processing liquid thereinside, an anilox roller that is partially immersed in the processing liquid of the processing liquid container, and a rubber roller that is pressed against the anilox roller and the recording medium 124 on the processing liquid drum 154 to transfer the processing liquid after measurement to the recording medium 124. According to the processing liquid application device 156, processing liquid can be applied onto the recording medium 124 while measuring the processing liquid. Although the configuration in which the application method using a roller is applied has been exemplified in the present embodiment, the present invention is not limited to this. For example, various methods, such as a spray method and an ink jet method, may be applied.

The recording medium 124 onto which processing liquid has been applied by the processing liquid application unit 114 is transported from the processing liquid drum 154 to the drawing drum 170 of the drawing unit 116 through a middle transport unit 126.

(Drawing Unit)

The drawing unit 116 includes the drawing drum 170, the paper pressing roller 174, and ink jet heads 172M, 172K, 172C, and 172Y. The drawing drum 170 includes claw-shaped holding means (gripper) 171 on its outer peripheral surface, similar to the processing liquid drum 154.

Each of the ink jet heads 172M, 172K, 172C, and 172Y is a full line type recording head (ink jet head) based on the ink jet method, which has a length corresponding to the maximum width of an image forming region in the recording medium 124. On the ink discharge surface of each ink jet head, a nozzle row in which a plurality of nozzles for ink discharge are arrayed over the entire image forming region is formed. Each of the ink jet heads 172M, 172K, 172C, and 172Y is placed so as to extend in a direction perpendicular to the transport direction of the recording medium 124 (rotation direction of the drawing drum 170).

By discharging droplets of corresponding color ink from each of the ink jet heads 172M, 172K, 172C, and 172Y toward the recording surface of the recording medium 124 that is held on the drawing drum 170 so as to be in close contact with the drawing drum 170, ink contacts the processing liquid applied onto the recording surface in advance by the processing liquid application unit 114, and the coloring material (pigment) dispersed in the ink aggregates. Accordingly, a coloring material aggregate is formed. As a result, the flow of the coloring material on the recording medium 124 is prevented, and an image is formed on the recording surface of the recording medium 124.

That is, an image can be recorded in the image forming region of the recording medium 124 by transporting the recording medium 124 at fixed speed using the drawing drum 170 and performing an operation for moving the recording medium 124 and each of the ink jet heads 172M, 172K, 172C, and 172Y relative to each other in the transport direction only once (that is, by one sub-scanning). In the single-pass type image formation using this full line type (page-wide) head, high-speed printing is possible compared with a case where a multi-pass method using a serial (shuttle) type head, which reciprocates in a direction (main scanning direction) perpendicular to the transport direction (sub-scanning direction) of a recording medium, is applied. As a result, the print productivity can be improved.

In addition, the present invention is not limited to the configuration of the standard colors (four colors) of CMYK, and light ink, dark ink, and special color ink may also be added when necessary. For example, a configuration in which an ink jet head from which light-based ink, such as light cyan or light magenta, is discharged is also possible, and the arrangement order of each color head is not particularly limited, either.

The recording medium 124 on which the image has been formed by the drawing unit 116 is transported from the drawing drum 170 to a drying drum 176 of the drying unit 118 through a middle transport unit 128.

(Drying Unit)

The drying unit 118 is a mechanism that dries the moisture included in the solvent separated by the coloring material aggregation action, and includes the drying drum 176 and a solvent drying device 178. Similar to the processing liquid drum 154, the drying drum 176 includes claw-shaped holding means (gripper) 177 on its outer peripheral surface. The tip of the recording medium 124 can be held by the holding means 177.

The solvent drying device 178 is disposed at a position facing the outer peripheral surface of the drying drum 176, and includes a plurality of halogen heaters 180 and hot air blowing nozzles 182 each of which is disposed between the halogen heaters 180. Various drying conditions can be realized by appropriately adjusting the temperature and amount of hot air which blows toward the recording medium 124 from each hot air blowing nozzle 182, and the temperature of each halogen heater 180.

The recording medium 124 which has been dried by the drying unit 118 is transported from the drying drum 176 to a fixing drum 184 of the fixing unit 120 through a middle transport unit 130.

(Fixing Unit)

The fixing unit 120 includes a fixing drum 184, a halogen heater 186, a fixing roller 188, and an in-line sensor 190. Similar to the processing liquid drum 154, the fixing drum 184 includes claw-shaped holding means (gripper) 185 on its outer peripheral surface. The tip of the recording medium 124 can be held by the holding means 185.

By the rotation of the fixing drum 184, the recording medium 124 is transported in a state where the recording surface faces outward, and preheating using the halogen heater 186, fixing processing using the fixing roller 188, and examination using the in-line sensor 190 are performed on the recording surface.

The fixing roller 188 is a roller member for coating the ink by heating and pressing the dried ink to weld the self-dispersing polymer particles in the ink, and is configured to heat and press the recording medium 124. The recording medium 124 is interposed between the fixing roller 188 and the fixing drum 184 and is nipped with predetermined nip pressure, and fixing processing is performed on the recording medium 124. In addition, the fixing roller 188 is formed by a heating roller including a halogen lamp or the like, and is controlled to have a predetermined temperature.

The in-line sensor 190 is means for reading an image (including a test pattern for density correction or a test pattern for non-discharging nozzle detection, a mark for nozzle position matching, and the like) formed on the recording medium 124 and detecting the density of the image, the defect of the image, and the like. For example, a CCD line sensor is applied. This in-line sensor 190 is equivalent to the scanner 20 described in FIG. 1.

In addition, instead of the ink containing a high boiling point solvent and polymer particles (thermoplastic resin particles), ink containing polymerizable monomer components that can be cured by ultraviolet (UV) exposure may be used. In this case, in the ink jet recording apparatus 100, means for irradiating active light, such as a UV lamp or an ultraviolet LD (laser diode) array, is provided instead of the fixing roller 188 for heating and fixing.

(Paper Discharge Unit)

The paper discharge unit 122 is provided subsequent to the fixing unit 120. The paper discharge unit 122 includes a paper discharge tray 192. A transfer barrel 194, a conveyor belt 196, and a tension roller 198 are provided between the paper discharge tray 192 and the fixing drum 184 of the fixing unit 120 so as to be in contact with these. The recording medium 124 is transported to a conveyor belt 196 by the transfer barrel 194, and is discharged by the paper discharge tray 192. Although the details of the paper transport mechanism using the conveyor belt 196 are not shown in the drawings, the tip of the recording medium 124 after printing is held by a gripper of a bar (not shown) transported between the endless conveyor belts 196 and is transported above the paper discharge tray 192 by the rotation of the conveyor belt 196.

Figure 16A:
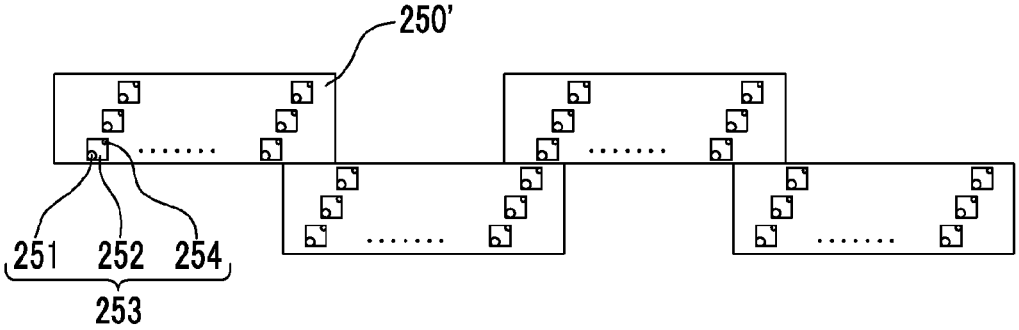
FIGS. 16A and 16B are perspective plan views showing other examples of the structure of the head.
Figure 16B:
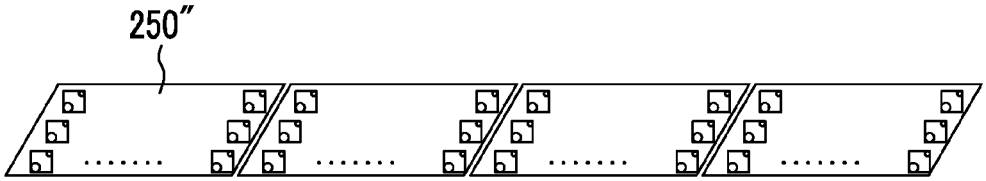

In addition, although not shown in FIGS. 16A and 16B, the ink jet recording apparatus 100 according to the present embodiment includes not only the above-described configuration but also an ink storage/loading unit that supplies ink to each of the ink jet heads 172M, 172K, 172C, and 172Y and means for supplying the processing liquid to the processing liquid application unit 114, and also includes a head maintenance unit that performs cleaning (wiping of the nozzle surface, purge, nozzle suction, and the like) of each of the ink jet heads 172M, 172K, 172C, and 172Y, a position detecting sensor that detects the position of the recording medium 124 on the paper transport path, a temperature sensor that detects the temperature of each unit of the apparatus, and the like.

<Structure of a Head>

Next, the structure of a head will be described. Since the structures of the heads 172M, 172K, 172C, and 172Y are the same, the representative head will be denoted by reference numeral 250 hereinafter.

Figure 15A:
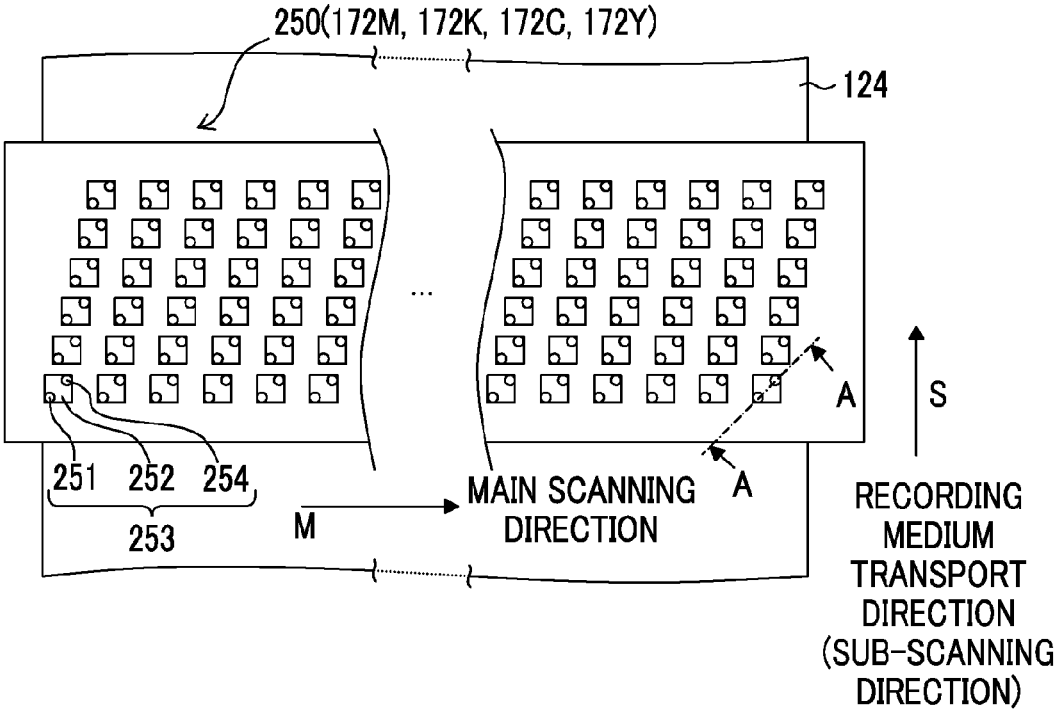
FIG. 15A is a perspective plan view showing an example of the structure of a head.
Figure 15B:
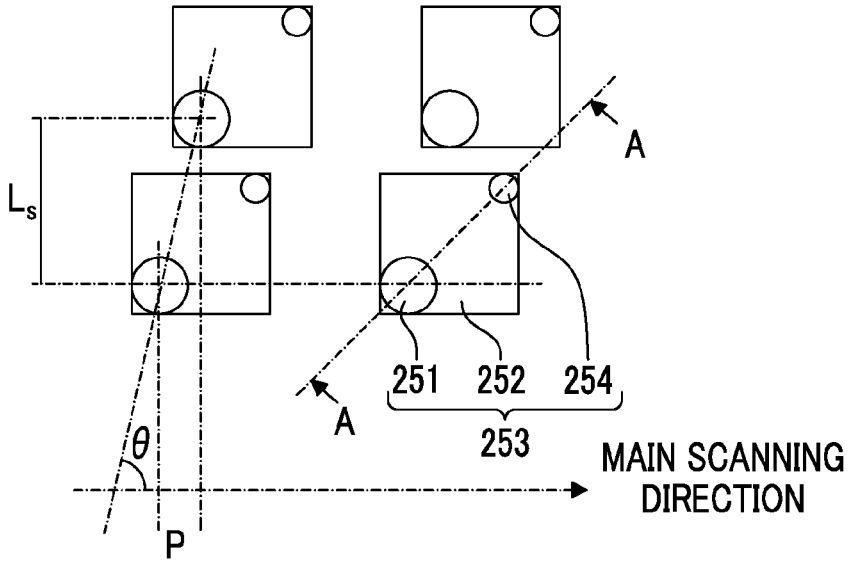
FIG. 15B is an enlarged view showing a part of the head.
Figure 17:
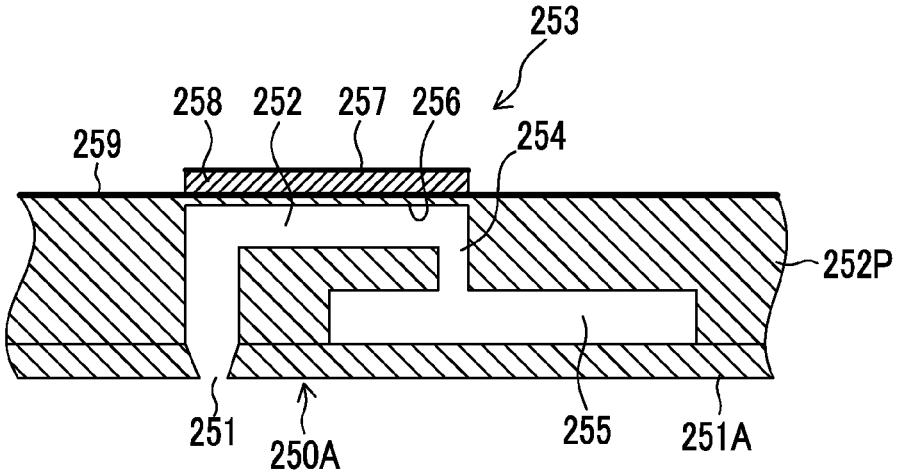
FIG. 17 is a cross-sectional view taken along the line A-A in FIG. 15A.

FIG. 15A is a perspective plan view showing an example of the structure of the head 250, and FIG. 15B is an enlarged view showing a part of the head 250. In addition, FIGS. 16A and 16B are perspective plan views showing other examples of the structure of the head 250, and FIG. 17 is a cross-sectional view (cross-sectional view taken along the line A-A in FIG. 15A) showing the three-dimensional configuration of droplet discharge elements (ink chamber unit corresponding to one nozzle 251) equivalent to one channel that is a recording element unit.

As shown in FIG. 15A, the head 250 in this example has a structure where a plurality of ink chamber units (droplet discharge elements) 253, each of which includes a nozzle 251 that is an ink discharge port, a pressure chamber 252 corresponding to each nozzle 251, and the like, are disposed in a two-dimensional manner in a matrix. In this manner, an increased density in the substantial distance between nozzles (projected nozzle pitch) projected (orthographically projected) so as to be aligned along the longitudinal direction of the head (direction perpendicular to the paper feed direction) is achieved.

The form in which a nozzle row equal to or larger than a length corresponding to the full width Wm of the drawing region of the recording medium 124 in a direction (direction of arrow M; main scanning direction) approximately perpendicular to the feed direction (direction of arrow S; sub-scanning direction) of the recording medium 124 is configured is not limited to this example. For example, instead of the configuration shown in FIG. 15A, there is also a configuration shown in FIG. 16A in which a line head having a nozzle row with a length corresponding to the full width of the recording medium 124 is formed by arraying the short head modules 250', in which a plurality of nozzles 251 are arrayed in a two-dimensional manner, in a zigzag manner and connecting the head modules 250' to each other or a configuration shown in FIG. 16B in which the head modules 250" are arrayed in a line and connected to each other.

The planar shape of the pressure chamber 252 provided corresponding to each nozzle 251 is an approximately square shape (refer to FIGS. 15A and 15B). An outlet to the nozzle 251 is provided in one of both corners on the diagonal line, and an inlet (supply port) 254 of supplied ink is provided in the other corner. In addition, the shape of the pressure chamber 252 is not limited to this example, but may be various planar shapes, such as a quadrangular shape (a rhombus, a rectangle, or the like), a pentagon, a hexagon, other polygons, a circle, and an ellipse.

As shown in FIG. 17, the head 250 has a structure where a nozzle plate 251A in which the nozzle 251 is formed, a flow path plate 252P in which a flow path such as the pressure chamber 252 or a common flow path 255 is formed, and the like are laminated and bonded to each other. The nozzle plate 251A forms a nozzle surface (ink discharge surface) 250A of the head 250, and the plurality of nozzles 251 communicating with each pressure chamber 252 is formed in a two-dimensional manner.

The flow path plate 252P forms a side wall portion of the pressure chamber 252, and is also a flow path forming member that forms a supply port 254 as a narrowed portion (most constricted portion) of the individual supply path that guides ink from the common flow path 255 to the pressure chamber 252. In addition, although simply shown in FIG. 17 for convenience of explanation, the flow path plate 252P has a structure where one or a plurality of substrates are laminated.

The nozzle plate 251A and the flow path plate 252P can be processed to have required shapes according to the semiconductor manufacturing process using silicon as a material.

The common flow path 255 communicates with an ink tank (not shown), which is an ink supply source, and the ink supplied from the ink tank is supplied to each pressure chamber 252 through the common flow path 255.

A piezoelectric actuator 258 including an individual electrode 257 is bonded to a diaphragm 256 which forms a part (FIG. 17, a top surface) of the surface of the pressure chamber 252. The diaphragm 256 in this example is formed of silicon (Si) with a conductive layer of nickel (Ni), which functions as a common electrode 259 equivalent to a lower electrode of the piezoelectric actuator 258, and also serves as a common electrode of the piezoelectric actuator 258 disposed corresponding to each pressure chamber 252. In addition, a diaphragm may be formed of a non-conductive material, such as a resin. In this case, a common electrode layer is formed on the surface of the diaphragm member using a conductive material, such as metal. In addition, a diaphragm that also serves as a common electrode may be formed using metal (conductive material), such as stainless steel (SUS).

By applying a driving voltage to the individual electrode 257, the piezoelectric actuator 258 is deformed and the volume of the pressure chamber 252 changes accordingly. As a result, ink is discharged from the nozzle 251 by the pressure change. When the piezoelectric actuator 258 returns to its original state after the ink discharge, new ink is refilled in the pressure chamber 252 through the supply port 254 from the common flow path 255.

A high-density nozzle head in this example is realized by arraying a plurality of ink chamber units 253 having the above-described structure in a predetermined grid array pattern in a row direction along the main scanning direction and a diagonal column direction having an angle θ that is not perpendicular to the main scanning direction as shown in FIG. 15B. Assuming that the distance between adjacent nozzles in the sub-scanning direction in this matrix array is Ls, the above arrangement in the main scanning direction can be regarded to be substantially equivalent to an arrangement in which the nozzles 251 are linearly arrayed at certain pitches $P=Ls/\tan\theta$.

In addition, when implementing the present invention, the arrangement form of the nozzle 251 in the head 250 is not limited to the example shown in the drawings, and various nozzle arrangement structures may be applied. For example, a linear arrangement of one row, a V-shaped nozzle arrangement, and a broken-line-shaped (zigzag-shaped; for example, W-shaped) nozzle arrangement having a V-shaped nozzle arrangement as a repetition unit are possible instead of the matrix arrangement described in FIG. 17.

In addition, means for generating the discharge pressure (discharge energy) for discharging droplets from each nozzle in the ink jet head is not limited to the piezoelectric actuator (piezoelectric element), and various pressure generating elements (energy generating elements), such as a heater (heating element) based on a thermal method (method of discharging ink using the pressure of film boiling by heating of a heater) and various actuators based on other methods, may be applied. An energy generating element corresponding to the discharge method of the head is provided in the flow path structure.

<Explanation of a Control System>

Figure 18:
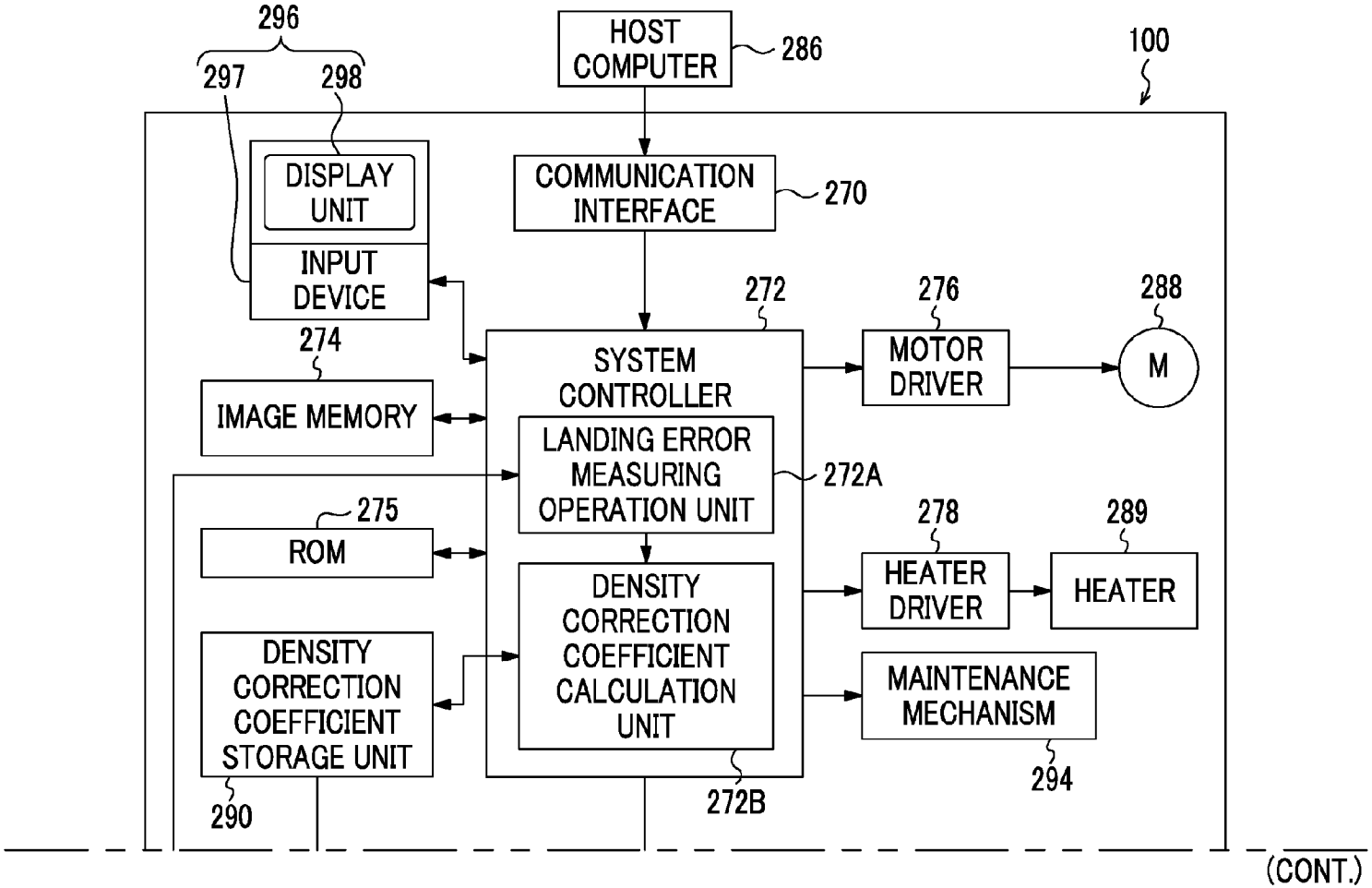
FIG. 18 is a block diagram showing the system configuration of an ink jet recording apparatus.

FIG. 18 is a block diagram showing the system configuration of the ink jet recording apparatus 100. As shown in FIG. 18, the ink jet recording apparatus 100 includes a communication interface 270, a system controller 272, an image memory 274, a ROM 275, a motor driver 276, a heater driver 278, a print control unit 280, an image buffer memory 282, a head driver 284, and the like.

The communication interface 270 is an interface unit (image input means) through which image data transmitted from a host computer 286 is received. Serial interfaces, such as a USB (Universal Serial Bus), IEEE 1394, Ethernet (registered trademark), and a radio network, or a Centronics parallel interface may be applied as the communication interface 270. A buffer memory (not shown) for increasing the communication speed may be mounted in the communication interface 270.

The image data transmitted from the host computer 286 is received by the ink jet recording apparatus 100 through the communication interface 270, and is temporarily stored in the image memory 274. The image memory 274 is storage means for storing an image input through the communication interface 270, and the reading and writing of data are performed through the system controller 272. Not only a memory formed of a semiconductor element but also a magnetic medium, such as a hard disk, may be used as the image memory 274.

The system controller 272 includes a central processing unit (CPU), peripheral circuits, and the like. The system controller 272 functions as a control unit that controls the entire ink jet recording apparatus 100 according to a predetermined program and also functions as an arithmetic unit that performs various operations. That is, the system controller 272 controls each unit of the communication interface 270, the image memory 274, motor driver 276, the heater driver 278, and the like, and performs control of communication with the host computer 286, reading and writing control of the image memory 274 and the ROM 275 and also generates a control signal to control a motor 288 and a heater 289 of the transport system.

In addition, the system controller 272 is configured to include a landing error measuring operation unit 272A that performs arithmetic processing for generating data of the position of a non-discharging nozzle or droplet landing position error, data (density data) indicating the density distribution, and the like from the read data that has been read from the in-line sensor 190 and a density correction coefficient calculation unit 272B that calculates a density correction coefficient from the information of the measured droplet landing position error and the density information. In addition, the processing functions of the landing error measuring operation unit 272A and the density correction coefficient calculation unit 272B can be realized by an ASIC, software, or an appropriate combination thereof. Data of the density correction coefficient calculated by the density correction coefficient calculation unit 272B is stored in a density correction coefficient storage unit 290.

Programs executed by the CPU of the system controller 272 and various kinds of data required for control (including a chart for the measurement of density correction parameters, data for ejecting droplets for the test chart to detect the non-discharging nozzle position, non-discharging nozzle information, and the like) are stored in the ROM 275. The ROM 275 may be non-rewriteable storage means or may be rewriteable storage means, such as an EEPROM. In addition, a storage region of the ROM 275 may be used to make the ROM 275 also serve as the density correction coefficient storage unit 290.

The image memory 274 is used not only as a temporary storage region of image data but also as a program loading region and an operating region of the CPU.

The motor driver 276 is a driver (driving circuit) that drives the motor 288 of the transport system according to the instruction from the system controller 272. The heater driver 278 is a driver that drives the heater 289 of the drying unit 118 or the like according to the instruction from the system controller 272.

The print control unit 280 function as signal processing means for performing various kinds of processing, correction, and the like for generating a droplet ejection control signal from the image data (data of a multi-level input image)

in the image memory 274 according to the control of the system controller 272, and also functions as driving control means for controlling the discharge driving of the head 250 by supplying the generated ink discharge data to the head driver 284.

That is, the print control unit 280 is configured to include a density data generation section 280A, a correction processing section 280B, an ink discharge data generation section 280C, and a driving waveform generation section 280D. These functional blocks 280A to 280D can be realized by an ASIC, software, or an appropriate combination thereof.

The density data generation section 280A is signal processing means for generating the initial density data of each ink color from the data of the input image, and performs density conversion processing (including UCR processing or color conversion) and performs pixel number conversion processing when necessary.

The correction processing section 280B is processing means for performing a density correction operation using the density correction coefficient stored in the density correction coefficient storage unit 290, and performs unevenness correction processing.

The ink discharge data generation section 280C is signal processing means including halftone processing means for converting the corrected image data (density data) generated by the correction processing section 280B into binary or multi-level dot data, and performs binary (multi-level) processing.

The ink discharge data generated by the ink discharge data generation section 280C is transmitted to the head driver 284, and the ink discharge operation of the head 250 is controlled.

The driving waveform generation section 280D is means for generating a driving signal waveform for driving the piezoelectric actuator 258 (refer to FIG. 17) corresponding to each nozzle 251 of the head 250, and the signal (driving waveform) generated by the driving waveform generation section 280D is supplied to the head driver 284. In addition, the signal output from the driving waveform generation section 280D may be digital waveform data or may be an analog voltage signal.

The driving waveform generation section 280D generates selectively a driving signal having a waveform for recording and a driving signal having a waveform for abnormal nozzle detection. Various kinds of waveform data are stored in the ROM 275 in advance, and the waveform data to be used if necessary is selectively output. The ink jet recording apparatus 100 shown in this example adopts a driving method in which a common driving power waveform signal is applied to each piezoelectric actuator 258 of the head 250 and ink is discharged from the nozzle 251 corresponding to each piezoelectric actuator 258 by performing ON/OFF switching of a switching device (not shown), which is connected to an individual electrode of each piezoelectric actuator 258, according to the discharge timing of each piezoelectric actuator 258.

The print control unit 280 includes the image buffer memory 282, and image data or data of parameters and the like are temporarily stored in the image buffer memory 282 at the time of image data processing in the print control unit 280. In addition, in FIG. 18, the image buffer memory 282 is shown in a manner associated with the print control unit 280. However, the image buffer memory 282 may also be used as the image memory 274. In addition, the print control unit 280 and the system controller 272 may be integrated as one processor.

Data of an image to be printed is input from the outside through the communication interface 270, and is stored in the image memory 274. In this stage, for example, multi-level image data of RGB is stored in the image memory 274.

In the ink jet recording apparatus 100, a continuous tone image that is not suitable for the human eyes is formed due to changing the ejection density or the dot size of fine dots created by ink (coloring material). Accordingly, the continuous tone image needs to be converted into the dot pattern so as to reproduce the gradation of the input digital image (shading of the image) as closely as possible. For this reason, data (for example, RGB data) of the original image stored in the image memory 274 is transmitted to the print control unit 280 through the system controller 272 and is then converted into dot data of each ink color through the density data generation section 280A, the correction processing section 280B, and the ink discharge data generation section 280C of the print control unit 280.

Generally, dot data is generated by performing color conversion processing and halftone processing on the image data. The color conversion processing is processing for converting image data (for example, 8-bit image data of RGB), which is expressed by sRGB or the like, into color data (in this example, color data of CMYK) of each color of the ink used in the ink jet printing machine.

The halftone processing is processing for converting the color data of each color, which is generated by the color conversion processing, into dot data (in this example, dot data of CMYK) of each color using an error diffusion method or a threshold value matrix method, for example.

That is, the print control unit 280 performs processing for converting the input RGB image data into dot data of four colors of K, C, M, and Y. The dot data generated by the print control unit 280 as described above is stored in the image buffer memory 282. The dot data of each color is converted into CMYK droplet ejection data for discharging ink from nozzles of the head 250. In this manner, ink discharge data to be printed is determined.

The head driver 284 includes an amplifier circuit, and outputs a driving signal, which is for driving the piezoelectric actuator 258 corresponding to each nozzle 251 of the head 250 according to the printing content, based on the driving signal waveform and the ink discharge data given from the print control unit 280. The head driver 284 may include a feedback control system for maintaining the head driving conditions constant.

When the driving signal output from the head driver 284 is given to the head 250 as described above, ink is discharged from the corresponding nozzle 251. By controlling the discharge of ink from the head 250 in synchronization with the transport speed of the recording medium 124, an image is formed on the recording medium 124.

As described above, based on the driving signal waveform and the ink discharge data generated through the required signal processing in the print control unit 280, the amount of discharge of ink droplets from each nozzle or the discharge timing is controlled by the head driver 284. In this manner, a desired dot size or dot arrangement is realized.

As described above in FIG. 14, the in-line sensor (detection unit) 190 is a block including an image sensor, and reads an image printed on the recording medium 124, detects the printing situation (the presence of discharge, variation in droplet ejection, optical density, and the like) by performing necessary signal processing or the like, and supplies the detection result to the print control unit 280 and the system controller 272.

The print control unit 280 performs control for performing various kinds of correction for the head 250 based on the information acquired from the in-line sensor 190 when necessary, and also performs control for performing preliminary discharge or suction and a cleaning operation (nozzle recovery operation), such as wiping, when necessary.

A maintenance mechanism 294 shown in FIG. 18 includes members required for head maintenance, such as an ink receiver, a suction cap, a suction pump, and a wiper blade.

In addition, an operating unit 296 as a user interface is configured to include an input device 297 and a display unit 298 that are required when an operator (user) performs various kinds of input. Various devices, such as a keyboard, a mouse, a touch panel, and a button, may be adopted as the input device 297. The operator can perform the input of printing conditions, selection of an image quality mode, input and editing of attached information, information search, and the like by operating the input device 297, and various kinds of information, such as the input content or the search result, can be checked through the display of the display unit 298. The display unit 298 also functions as means for displaying a warning, such as an error message.

In addition, all or some of the processing functions of the landing error measuring operation unit 272A, the density correction coefficient calculation unit 272B, the density data generation section 280A, and the correction processing section 280B described in FIG. 18 may be installed in the host computer 286. In addition, a configuration is also possible in which the host computer 286 is responsible for all or some of the functions of the system controller 272. The computer 18 described in FIG. 1 may be used as the host computer 286, or other computers may be used. In addition, the image processing device 22 described in FIG. 1 may be built into the host computer 286, or may be built into the ink jet recording apparatus 100.

The ink jet recording apparatus 100 described in FIGS. 14 to 18 or the combination of the ink jet recording apparatus 100 and the host computer 286 is equivalent to a "printing system". The drawing drum 170 is equivalent to a "relative movement unit", and the combination of the system controller 272 and the print control unit 280 is equivalent to "discharge control means".

Advantages of the Present Embodiment

According to the embodiment of the present invention described above, a defective nozzle is appropriately detected by taking the human visual characteristics into consideration. In addition, as described in the drawings, a nozzle number is accurately specified by recording a mark (pattern), which shows the positional relationship between the nozzle position and the pixel position of read data, outside the image region and by reading this mark. In addition, as described in the second embodiment, a lower resolution than the output resolution of the printer may be adopted as the resolution of the scanner, which is determined from the cut-off frequency of the visual characteristics. In this manner, a defective nozzle can be detected at high speed and low cost. In this case, as described above in the third embodiment, a nozzle number is accurately specified by printing a defective nozzle specifying pattern (nozzle number specifying chart).

<Other Modifications>

Although the ink jet recording apparatus that uses a method of forming an image by ejecting ink droplets directly onto the recording medium 124 (direct recording method) has been described in the above embodiments, the application range of the present invention is not limited to this. The present invention may also be applied to an intermediate transfer type image forming apparatus that forms an image (primary image) on the intermediate transfer body first and forming a final image by transferring the image to recording paper using a transfer unit.

<Regarding Means for Moving a Head and Paper Relative to Each Other>

Although the configuration of transporting a recording medium to the stopped head has been described in the above embodiments, a configuration of moving a head to the stopped recording medium (medium on which drawing is to be performed) is also possible when implementing the present invention.

<Regarding a Recording Medium>

The "recording medium" is a generic term for a medium on which dots are recorded by droplets discharged from the liquid discharge head, and may be referred to as various terms, such as a printing medium, a medium to be recorded, a medium on which an image is formed, an image receiving medium, and a medium onto which droplets are discharged. When implementing the present invention, a material, shape, and the like of the recording medium is not particularly limited, and applications to various media, such as continuous paper, cut sheet, seal paper, a resin sheet (for example, an OHP sheet), a film, a fabric, a nonwoven fabric, a printed circuit board on which wiring patterns and the like are formed, and a rubber sheet, can be made regardless of materials or shapes.

<Examples of the Application to Apparatuses>

Although an example of the application to the ink jet recording apparatus for graphic printing has been described in the above embodiments, the application range of the present invention is not limited to this example. For example, the present invention may be widely applied to ink jet apparatuses that draw various shapes or patterns using a liquid functional material, such as a wiring drawing apparatus that draws the wiring pattern of an electronic circuit, apparatuses for manufacturing various devices, a resist printing apparatus that uses resin liquid as functional liquid for discharge, a color filter manufacturing apparatus, and a fine structure forming apparatus that forms a fine structure using a material for material deposition.

In the embodiments of the present invention described above, constituent components may be appropriately changed, added, and deleted in a range not departing from the spirit and scope of the present invention. The present invention is not limited to the embodiments described above, and various modifications may be made within the technical idea of the present invention by those skilled in the art.

<Various Aspects of the Present Invention Disclosed>

As can be seen from the above embodiments described in detail, this specification and the drawings include disclosure of various technical ideas including inventions described below.

(First aspect): A discharge defect detection method including: an image reading step of reading an image recorded on a medium to acquire read data of the image, the image being recorded on the medium by discharging liquid from a plurality of nozzles based on image data while moving a liquid discharge head having a nozzle row, in which the plurality of nozzles is aligned, and the medium relative to each other; a visual characteristic correction step of performing a filtering process corresponding to human visual characteristics for the read data acquired in the image reading step; a nozzle position matching step of specifying a correspondence relationship between a pixel position of the read data and a nozzle position in the liquid discharge head from a mark that is recorded in a margin outside an image region on the medium by a nozzle set in advance; a resolution conversion step of converting data, for which the filtering process has been performed in the visual characteristic correction step, into data having a nozzle resolution of the liquid discharge head using the correspondence relationship specified in the nozzle position matching step; a reference data generation step of generating reference data, which indicates a reference image, from the image data or the read data acquired in the image reading step; a reference data storage step of storing the reference data generated in the reference data generation step; and a defect detection step of detecting a discharge defect of a nozzle in the nozzle row by comparing the read data for which nozzle resolution conversion has been performed, which is generated by performing the filtering process in the visual characteristic correction step and a process for conversion into the nozzle resolution in the resolution conversion step for the read data generated from the image read in the image reading step, with the reference data for which nozzle resolution conversion has been performed, which is generated through the filtering process corresponding to the visual characteristics and the process for conversion into the nozzle resolution of the liquid discharge head.

According to this aspect, when detecting a discharge defect of a nozzle by comparing the data (reference data) of a reference image with the read data of a read image, matching between the pixel position of the read data and the nozzle position is performed. Therefore, high-precision matching is possible. In addition, since data items that are converted to have the nozzle resolution by performing the filtering process for both the data of a reference image and the data of a read image in consideration of the human visual characteristics are compared with each other, a discharge defect of a nozzle can be accurately detected.

(Second aspect): In the discharge defect detection method according to the first aspect, in the reference data storage step, the reference data for which the nozzle resolution conversion has been performed may be stored in a storage unit.

As the reference data, it is preferable to store data after conversion that is obtained after performing the filtering process corresponding to the visual characteristics and the process for conversion into the nozzle resolution. When generating the reference data from the image data, it is preferable to perform the same process as the filtering process or the process for conversion into the nozzle resolution performed for the read data and to store the result as reference data after nozzle resolution conversion.

(Third aspect): The discharge defect detection method according to the first or second aspect may further include: a read characteristic correction step of performing a correction process corresponding to a frequency characteristic of an image reading unit used in the image reading step, for the read data acquired in the image reading step.

For example, when a low-resolution scanner (image reading means) is used, it is preferable to perform correction so as to compensate for the influence by the frequency response characteristics (MTF characteristics) of the image reading means.

(Fourth aspect): In the discharge defect detection method according to any one of the first to third aspects, assuming that a direction of relative movement of the medium with respect to the liquid discharge head is a first direction and a width direction of the medium perpendicular to the first direction is a second direction, the liquid discharge head has a row of nozzles with which a drawing region on the medium is recorded by performing the relative movement once in the second direction over an entire width of the drawing region.

According to this aspect, a defective nozzle in a single-pass type liquid discharge head can be effectively detected.

(Fifth aspect): In the discharge defect detection method according to any one of the first to fourth aspects, in the image reading step, the image recorded on the medium is read with the image reading unit, which is placed on a medium transport path along which the medium on which recorded is the image by the liquid discharge head is transported, while the medium is transport along the medium transport path According to this aspect, even when a large number of images are recorded, the quality of each image can be checked.

(Sixth aspect): In the discharge defect detection method according to any one of the first to fifth aspects, the defect detection step may include a difference calculation step of calculating a difference between the read data for which the nozzle resolution conversion has been performed and the reference data for which the nozzle resolution conversion has been performed. An integrated value of the difference may be calculated for each nozzle position, and a nozzle, for which the integrated value of the difference exceeds a threshold value set in advance, may be determined to be a discharge-defective nozzle among the plurality of nozzles.

(Seventh aspect): The discharge defect detection method according to any one of the first to sixth aspects may further include a chart output step of outputting a nozzle specifying chart for specifying a position of the discharge-defective nozzle in a case where a discharge defect is detected in the defect detection step.

According to this aspect, even when image reading means having a lower resolution than the recording resolution of the liquid discharge head is used, the position of a defective nozzle position can be correctly specified.

(Eighth aspect): A discharge defect detection apparatus including: an image reading unit that reads an image recorded on a medium to acquire read data of the image, the image being recorded on the medium by discharging liquid from a plurality of nozzles based on image data while moving a liquid discharge head having a nozzle row, in which the plurality of nozzles is aligned, and the medium relative to each other; a visual characteristic correction unit that performs a filtering process corresponding to human visual characteristics for the read data acquired by the image reading unit; a nozzle position matching unit that specifies a correspondence relationship between a pixel position of the read data and a nozzle position in the liquid discharge head from a mark that is recorded in a margin outside an image region on the medium by a nozzle set in advance; a resolution conversion unit that converts data, for which the filtering process by the visual characteristic correction unit has been performed, into data having a nozzle resolution of the liquid discharge head using the correspondence relationship specified by the nozzle position matching unit; a reference data generation unit that generates reference data, which indicates a reference image, from the image data or the read data acquired by the image reading unit; a reference data storage unit that stores the reference data generated by the reference data generation unit; and a defect detection unit that detects a discharge defect of a nozzle in the nozzle row by comparing the read data for which the nozzle resolution conversion has been performed, which is generated by performing the filtering process using the visual characteristic correction unit and a process for conversion into the nozzle resolution using the resolution conversion unit for the read data generated from the image read by the image reading unit, with the reference data for which the nozzle resolution conversion has been performed, which is generated through the filtering process corresponding to the visual characteristics and the process for conversion into the nozzle resolution of the liquid discharge head.

For the discharge defect detection apparatus according to the eighth aspect, the same features as in the second to seventh aspects can be combined. In this case, a "unit" corresponding to the "step" when the method is specified is included.

(Ninth aspect): An image processing apparatus including: a data acquisition unit that acquires read data of an image, by reading the image recorded on a medium with an image reading unit, the image being recorded on a medium by discharging liquid from a plurality of nozzles based on image data while moving a liquid discharge head having a nozzle row, in which the plurality of nozzles is aligned, and the medium relative to each other; a visual characteristic correction unit that performs a filtering process corresponding to human visual characteristics for the read data acquired by the data acquisition unit; a nozzle position matching unit that specifies a correspondence relationship between a pixel position of the read data and a nozzle position in the liquid discharge head from a mark that is recorded in a margin outside an image region on the medium by a nozzle set in advance; a resolution conversion unit that converts data, for which the filtering process has been performed by the visual characteristic correction unit, into data having a nozzle resolution of the liquid discharge head using the correspondence relationship specified by the nozzle position matching unit; a reference data generation unit that generates reference data, which indicates a reference image, from the image data or the read data acquired by the image reading unit; a reference data storage unit that stores the reference data generated by the reference data generation unit; and a defect detection unit that detects a discharge defect of a nozzle in the nozzle row by comparing the read data for which nozzle resolution conversion has been performed, which is generated by performing the filtering process using the visual characteristic correction unit and a process for conversion into the nozzle resolution using the resolution conversion unit for the read data generated from the image read by the image reading unit, with the reference data for which nozzle resolution conversion has been performed, which is generated through the filtering process corresponding to the visual characteristics and the process for conversion into the nozzle resolution of the liquid discharge head.

For the image processing apparatus according to the ninth aspect, the same features as in the second to seventh aspects can be combined. In this case, a "unit" corresponding to the "step" when the method is specified is included.

In addition, an image processing method including a step corresponding to each unit in the image processing apparatus according to the ninth aspect can be provided.

(Tenth aspect): A non-transitory computer-readable recording medium on which recorded is a program for causing a computer to function as an image processing apparatus. The image processing apparatus includes a data acquisition unit that acquires read data of an image, by reading the image recorded on a medium with an image reading unit, the image being recorded on a medium by discharging liquid from a plurality of nozzles based on image data while moving a liquid discharge head having a nozzle row, in which the plurality of nozzles is aligned, and the medium relative to each other; a visual characteristic correction unit that performs a filtering process corresponding to human visual characteristics for the read data acquired by the data acquisition unit; a nozzle position matching unit that specifies a correspondence relationship between a pixel position of the read data and a nozzle position in the liquid discharge head from a mark that is recorded in a margin outside an image region on the medium by a nozzle set in advance; a resolution conversion unit that converts data, for which the filtering process has been performed by the visual characteristic correction unit, into data having a nozzle resolution of the liquid discharge head using the correspondence relationship specified by the nozzle position matching unit; a reference data generation unit that generates reference data, which indicates a reference image, from the image data or the read data acquired by the image reading unit; a reference data storage unit that stores the reference data generated by the reference data generation unit; and a defect detection unit that detects a discharge defect of a nozzle in the nozzle row by comparing the read data for which nozzle resolution conversion has been performed, which is generated by performing the filtering process using the visual characteristic correction unit and a process for conversion into the nozzle resolution using the resolution conversion unit for the read data generated from the image read by the image reading unit, with the reference data for which nozzle resolution conversion has been performed, which is generated through the filtering process corresponding to the visual characteristics and the process for conversion into the nozzle resolution of the liquid discharge head.

For the non-transitory computer-readable recording medium according to the tenth aspect, the same features as in the second to seventh aspects can be combined. In this case, the non-transitory computer-readable recording medium described above becomes a non-transitory computer-readable recording medium that stores a program causing a computer to function as an image processing apparatus including a "unit" corresponding to the "step" when the method is specified.

(Eleventh aspect): A printing system including: a liquid discharge head including a nozzle row in which a plurality of nozzles is aligned; relative movement means for moving a medium, on which liquid discharged from the nozzles is deposited, and the liquid discharge head relative to each other; printing control means for performing control for discharging the liquid from the nozzles of the liquid discharge head based on image data in order to form an image on the medium; and the discharge defect detection apparatus according to the eighth aspect.

What is claimed is:

1. A discharge defect detection method comprising:

an image reading step of reading an image recorded on a medium to acquire read data of the image, the image being recorded on the medium by discharging liquid from a plurality of nozzles based on image data while moving a liquid discharge head having a nozzle row, in which the plurality of nozzles is aligned, and the medium relative to each other;

a visual characteristic correction step of performing a filtering process corresponding to human visual characteristics for the read data acquired in the image reading step;

a nozzle position matching step of specifying a correspondence relationship between a pixel position of the read data and a nozzle position in the liquid discharge head from a mark that is recorded in a margin outside an image region on the medium by a nozzle set in advance;

a resolution conversion step of converting data, for which the filtering process has been performed in the visual characteristic correction step, into data having a nozzle resolution of the liquid discharge head using the correspondence relationship specified in the nozzle position matching step;

a reference data generation step of generating reference data, which indicates a reference image, from the image data or the read data acquired in the image reading step;

a reference data storage step of storing the reference data generated in the reference data generation step; and a defect detection step of detecting a discharge defect of a nozzle in the nozzle row by comparing the read data for which nozzle resolution conversion has been performed, which is generated by performing the filtering process in the visual characteristic correction step and a process for conversion into the nozzle resolution in the resolution conversion step for the read data generated from the image read in the image reading step, with the reference data for which nozzle resolution conversion has been performed, which is generated through the filtering process corresponding to the visual characteristics and the process for conversion into the nozzle resolution of the liquid discharge head.

2. The discharge defect detection method according to claim 1, wherein, in the reference data storage step, the reference data for which the nozzle resolution conversion has been performed is stored in a storage unit.

3. The discharge defect detection method according to claim 2, further comprising:

a read characteristic correction step of performing a correction process corresponding to a frequency characteristic of an image reading unit used in the image reading step, for the read data acquired in the image reading step.

4. The discharge defect detection method according to claim 2, wherein, assuming that a direction of relative movement of the medium with respect to the liquid discharge head is a first direction and a width direction of the medium perpendicular to the first direction is a second direction, the liquid discharge head has a row of nozzles with which a drawing region on the medium is recorded by performing the relative movement once in the second direction over an entire width of the drawing region.

5. The discharge defect detection method according to claim 2, wherein, in the image reading step, the image recorded on the medium is read with the image reading unit, which is placed on a medium transport path along which the medium on which recorded is the image by the liquid discharge head is transported, while the medium is transport along the medium transport path.

6. The discharge defect detection method according to claim 2, wherein the defect detection step includes a difference calculation step of calculating a difference between the read data for which the nozzle resolution conversion has been performed and the reference data for which the nozzle resolution conversion has been performed, and an integrated value of the difference is calculated for each nozzle position, and a nozzle, for which the integrated value of the difference exceeds a threshold value set in advance, is determined to be a discharge-defective nozzle among the plurality of nozzles.

7. The discharge defect detection method according to claim 2, further comprising:

a chart output step of outputting a nozzle specifying chart for specifying a position of the discharge-defective nozzle in a case where a discharge defect is detected in the defect detection step.

8. The discharge defect detection method according to claim 1, further comprising:

a read characteristic correction step of performing a correction process corresponding to a frequency characteristic of an image reading unit used in the image reading step, for the read data acquired in the image reading step.

9. The discharge defect detection method according to claim 8, wherein, assuming that a direction of relative movement of the medium with respect to the liquid discharge head is a first direction and a width direction of the medium perpendicular to the first direction is a second direction, the liquid discharge head has a row of nozzles with which a drawing region on the medium is recorded by performing the relative movement once in the second direction over an entire width of the drawing region.

10. The discharge defect detection method according to claim 8, wherein, in the image reading step, the image recorded on the medium is read with the image reading unit, which is placed on a medium transport path along which the medium on which recorded is the image by the liquid discharge head is transported, while the medium is transport along the medium transport path.

11. The discharge defect detection method according to claim 8, wherein the defect detection step includes a difference calculation step of calculating a difference between the read data for which the nozzle resolution conversion has been performed and the reference data for which the nozzle resolution conversion has been performed, and an integrated value of the difference is calculated for each nozzle position, and a nozzle, for which the integrated value of the difference exceeds a threshold value set in advance, is determined to be a discharge-defective nozzle among the plurality of nozzles.

12. The discharge defect detection method according to claim 8, further comprising:

a chart output step of outputting a nozzle specifying chart for specifying a position of the discharge-defective nozzle in a case where a discharge defect is detected in the defect detection step.

13. The discharge defect detection method according to claim 1, wherein, assuming that a direction of relative movement of the medium with respect to the liquid discharge head is a first direction and a width direction of the medium perpendicular to the first direction is a second direction, the liquid discharge head has a row of nozzles with which a drawing region on the medium is recorded by performing the relative movement once in the second direction over an entire width of the drawing region.

14. The discharge defect detection method according to claim 1, wherein, in the image reading step, the image recorded on the medium is read with the image reading unit, which is placed on a medium transport path along which the medium on which recorded is the image by the liquid discharge head is transported, while the medium is transport along the medium transport path.

15. The discharge defect detection method according to claim 1, wherein the defect detection step includes a difference calculation step of calculating a difference between the read data for which the nozzle resolution conversion has been performed and the reference data for which the nozzle resolution conversion has been performed, and an integrated value of the difference is calculated for each nozzle position, and a nozzle, for which the integrated value of the difference exceeds a threshold value set in advance, is determined to be a discharge-defective nozzle among the plurality of nozzles.

16. The discharge defect detection method according to claim 1, further comprising:

a chart output step of outputting a nozzle specifying chart for specifying a position of the discharge-defective nozzle in a case where a discharge defect is detected in the defect detection step.

17. A discharge defect detection apparatus comprising:

an image reading unit that reads an image recorded on a medium to acquire read data of the image, the image being recorded on the medium by discharging liquid from a plurality of nozzles based on image data while moving a liquid discharge head having a nozzle row, in which the plurality of nozzles is aligned, and the medium relative to each other;

a visual characteristic correction unit that performs a filtering process corresponding to human visual characteristics for the read data acquired by the image reading unit;

a nozzle position matching unit that specifies a correspondence relationship between a pixel position of the read data and a nozzle position in the liquid discharge head from a mark that is recorded in a margin outside an image region on the medium by a nozzle set in advance;

a resolution conversion unit that converts data, for which the filtering process by the visual characteristic correction unit has been performed, into data having a nozzle resolution of the liquid discharge head using the correspondence relationship specified by the nozzle position matching unit;

a reference data generation unit that generates reference data, which indicates a reference image, from the image data or the read data acquired by the image reading unit;

a reference data storage unit that stores the reference data generated by the reference data generation unit; and a defect detection unit that detects a discharge defect of a nozzle in the nozzle row by comparing the read data for which the nozzle resolution conversion has been performed, which is generated by performing the filtering process using the visual characteristic correction unit and a process for conversion into the nozzle resolution using the resolution conversion unit for the read data generated from the image read by the image reading unit, with the reference data for which the nozzle resolution conversion has been performed, which is generated through the filtering process corresponding to the visual characteristics and the process for conversion into the nozzle resolution of the liquid discharge head.

18. A printing system comprising:

a liquid discharge head including a nozzle row in which a plurality of nozzles is aligned;

a relative movement unit that moves a medium, on which liquid discharged from the nozzles is deposited, and the liquid discharge head relative to each other;

a printing control unit that performs control for discharging the liquid from the nozzles of the liquid discharge head based on image data in order to form an image on the medium; and the discharge defect detection apparatus according to claim 17.

19. An image processing apparatus comprising:

a data acquisition unit that acquires read data of an image, by reading the image recorded on a medium with an image reading unit, the image being recorded on a medium by discharging liquid from a plurality of nozzles based on image data while moving a liquid discharge head having a nozzle row, in which the plurality of nozzles is aligned, and the medium relative to each other;

a visual characteristic correction unit that performs a filtering process corresponding to human visual characteristics for the read data acquired by the data acquisition unit;

a nozzle position matching unit that specifies a correspondence relationship between a pixel position of the read data and a nozzle position in the liquid discharge head from a mark that is recorded in a margin outside an image region on the medium by a nozzle set in advance;

a resolution conversion unit that converts data, for which the filtering process has been performed by the visual characteristic correction unit, into data having a nozzle resolution of the liquid discharge head using the correspondence relationship specified by the nozzle position matching unit;

a reference data generation unit that generates reference data, which indicates a reference image, from the image data or the read data acquired by the image reading unit;

a reference data storage unit that stores the reference data generated by the reference data generation unit; and a defect detection unit that detects a discharge defect of a nozzle in the nozzle row by comparing the read data for which nozzle resolution conversion has been performed, which is generated by performing the filtering process using the visual characteristic correction unit and a process for conversion into the nozzle resolution using the resolution conversion unit for the read data generated from the image read by the image reading unit, with the reference data for which nozzle resolution conversion has been performed, which is generated through the filtering process corresponding to the visual characteristics and the process for conversion into the nozzle resolution of the liquid discharge head.

20. A non-transitory computer-readable recording medium on which recorded is a program for causing a computer to function as an image processing apparatus comprising:

a data acquisition unit that acquires read data of an image, by reading the image recorded on a medium with an image reading unit, the image being recorded on a medium by discharging liquid from a plurality of nozzles based on image data while moving a liquid discharge head having a nozzle row, in which the plurality of nozzles is aligned, and the medium relative to each other;

a visual characteristic correction unit that performs a filtering process corresponding to human visual characteristics for the read data acquired by the data acquisition unit;

a nozzle position matching unit that specifies a correspondence relationship between a pixel position of the read data and a nozzle position in the liquid discharge head from a mark that is recorded in a margin outside an image region on the medium by a nozzle set in advance;

a resolution conversion unit that converts data, for which the filtering process has been performed by the visual characteristic correction unit, into data having a nozzle resolution of the liquid discharge head using the correspondence relationship specified by the nozzle position matching unit;

a reference data generation unit that generates reference data, which indicates a reference image, from the image data or the read data acquired by the image reading unit;

a reference data storage unit that stores the reference data generated by the reference data generation unit; and a defect detection unit that detects a discharge defect of a nozzle in the nozzle row by comparing the read data for which nozzle resolution conversion has been performed, which is generated by performing the filtering process using the visual characteristic correction unit and a process for conversion into the nozzle resolution using the resolution conversion unit for the read data generated from the image read by the image reading unit, with the reference data for which nozzle resolution conversion has been performed, which is generated through the filtering process corresponding to the visual characteristics and the process for conversion into the nozzle resolution of the liquid discharge head.

* * * * *